US009772569B2

(12) United States Patent
Tanaka et al.

(10) Patent No.: US 9,772,569 B2
(45) Date of Patent: Sep. 26, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Daisuke Tanaka, Yokohama (JP); Kazumichi Sugiyama, Numazu (JP); Takeshi Murakami, Numazu (JP); Daisuke Kawaguchi, Toride (JP); Yota Ito, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/169,399

(22) Filed: May 31, 2016

(65) Prior Publication Data

US 2016/0378002 A1 Dec. 29, 2016

(30) Foreign Application Priority Data

Jun. 24, 2015 (JP) ..... 2015-126309

(51) Int. Cl.

| | |
|---|---|
| ***G03G 5/14*** | (2006.01) |
| ***G03G 15/00*** | (2006.01) |
| ***G03G 21/18*** | (2006.01) |

(52) U.S. Cl.

CPC ..... *G03G 5/144* (2013.01); *G03G 15/75* (2013.01); *G03G 21/18* (2013.01)

(58) Field of Classification Search

CPC ..... G03G 5/144; G03G 15/75; G03G 21/18

See application file for complete search history.

(56) References Cited

U.S. PATENT DOCUMENTS

| | | | |
|---|---|---|---|
| 4,908,329 | A | 3/1990 | Kanai et al. |
| 4,908,330 | A | 3/1990 | Arai et al. |
| 5,759,291 | A | 6/1998 | Ichinose et al. |
| 6,562,530 | B2 | 5/2003 | Morikawa et al. |
| 6,806,009 | B2 | 10/2004 | Tanaka et al. |
| 6,815,135 | B2 | 11/2004 | Morikawa et al. |
| 6,835,512 | B2 | 12/2004 | Morikawa et al. |
| 6,913,862 | B2 | 7/2005 | Nakata et al. |
| 6,998,210 | B2 | 2/2006 | Yoshimura et al. |
| 7,022,446 | B2 | 4/2006 | Yoshimura et al. |
| 7,078,140 | B2 | 7/2006 | Yoshimura et al. |
| 8,632,935 | B2 | 1/2014 | Sugiyama et al. |
| 8,765,335 | B2 | 7/2014 | Tanaka et al. |
| 8,778,580 | B2 | 7/2014 | Tsuji et al. |
| 8,841,052 | B2 | 9/2014 | Watariguchi et al. |
| 8,940,189 | B2 | 1/2015 | Krietsch et al. |

(Continued)

FOREIGN PATENT DOCUMENTS

| | | |
|---|---|---|
| JP | H06-208238 | 7/1994 |
| JP | H07-295270 | 11/1995 |

(Continued)

OTHER PUBLICATIONS

"Handbook of Crosslinking Agents," edited by Shinzo Yamashita and Tosuke Kaneko, published by Taiseisha Ltd. (1981).

*Primary Examiner* — Thorl Chea

(74) *Attorney, Agent, or Firm* — Fitzpatrick Cella Harper and Scinto

(57) ABSTRACT

An undercoat layer of an electrophotographic photosensitive member includes a binder resin, and a complex particle composed of a core particle coated with tin oxide doped with zinc.

11 Claims, 1 Drawing Sheet

(56) References Cited

U.S. PATENT DOCUMENTS

| | | | |
|---|---|---|---|
| 8,974,991 | B2 | 3/2015 | Kawahara et al. |
| 9,029,054 | B2 | 5/2015 | Okuda et al. |
| 9,063,505 | B2 | 6/2015 | Sekiya et al. |
| 9,068,083 | B2 | 6/2015 | Tanaka et al. |
| 9,069,267 | B2 | 6/2015 | Kaku et al. |
| 9,158,213 | B2 | 10/2015 | Taniguchi et al. |
| 9,164,406 | B2 | 10/2015 | Nishi et al. |
| 9,170,506 | B2 | 10/2015 | Tanaka et al. |
| 9,170,507 | B2 | 10/2015 | Sugiyama et al. |
| 9,256,145 | B2 | 2/2016 | Fujii et al. |
| 9,274,496 | B2 | 3/2016 | Miyagawa et al. |
| 9,280,071 | B2 | 3/2016 | Maruyama et al. |
| 9,304,414 | B2 | 4/2016 | Miura et al. |
| 9,405,206 | B2 | 8/2016 | Kawaguchi et al. |
| 9,411,307 | B2 | 8/2016 | Matsuda et al. |
| 9,436,107 | B2 | 9/2016 | Murakami et al. |
| 9,459,542 | B2 | 10/2016 | Tanaka et al. |
| 2014/0212800 | A1 | 7/2014 | Miura et al. |
| 2015/0185630 | A1 | 7/2015 | Ito et al. |
| 2015/0185634 | A1 | 7/2015 | Sekiya et al. |
| 2015/0185636 | A1 | 7/2015 | Sekiya et al. |
| 2015/0185638 | A1 | 7/2015 | Nakamura et al. |
| 2016/0026098 | A1 | 1/2016 | Murakami et al. |

FOREIGN PATENT DOCUMENTS

| | | |
|---|---|---|
| JP | 2008-026480 | 2/2008 |
| JP | 4105861 | 6/2008 |
| JP | 4301589 | 7/2009 |
| JP | 2011-506700 | 3/2011 |
| JP | 2012-018370 | 1/2012 |
| JP | 2012-018371 | 1/2012 |

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus including an electrophotographic photosensitive member.

Description of the Related Art

An electrophotographic photosensitive member used in electrophotographic apparatuses includes an undercoat layer and a photosensitive layer formed on a support in this order. Known measures of enhancing the conductivity of the electrophotographic photosensitive member include a technique of containing metal oxide particles in an undercoat layer. Japanese Patent Application Laid-Open Nos. 2012-18371 and 2012-18370 disclose techniques using a titanium oxide particle coated with tin oxide doped with phosphorus or tungsten in an undercoat layer. Japanese Patent Application Laid-Open No. 2012-18370 also discloses a technique using a zinc oxide particle doped with aluminum in an undercoat layer. Furthermore, Japanese Patent Application Laid-Open Nos. H06-208238 and H07-295270 disclose techniques using a barium sulfate particle coated with tin oxide in an intermediate layer (undercoat layer) disposed between a support and a photosensitive layer. Electrophotographic photosensitive members including undercoat layers containing these conventional metal oxide particles provide images satisfying quality currently required.

SUMMARY OF THE INVENTION

A further enhancement in performance of electrophotographic photosensitive members in repeated use, however, has been required with an increase in speed of the electrophotographic apparatus (an increase in process speed). The present inventors, who have conducted extensive research, have found that as the process speeds of electrophotographic apparatuses are increased, the following problems occur in those electrophotographic photosensitive members including undercoat layers containing the metal oxide particles described in the above documents. Namely, the present inventors have found that repeated formation of images under environments at low temperature and low humidity readily causes charging streaks in output images, and the conventional electrophotographic photosensitive members are still susceptible to improvement. The charging streaks indicate image defects in the form of streaks in the direction intersecting perpendicular to the circumferential direction of the surface of the electrophotographic photosensitive member. These image defects are caused by a reduction in uniformity (uneven charge) of the surface potential of the electrophotographic photosensitive member during charging of the surface of the electrophotographic photosensitive member. The charging streaks are particularly readily generated in output of halftone images.

The present invention is directed to providing an electrophotographic photosensitive member which prevents charging streaks in repeated formation of images under environments at low temperature and low humidity, and a process cartridge and an electrophotographic apparatus including the electrophotographic photosensitive member.

According to one aspect of the present invention, there is provided an electrophotographic photosensitive member comprising a support, an undercoat layer formed on the support, and a photosensitive layer formed on the undercoat layer, wherein the undercoat layer contains a binder resin, and a complex particle composed of a core particle coated with tin oxide doped with zinc, and the mass ratio of the complex particle to the binder resin is 1/1 or more.

According to another aspect of the present invention, there is provided a process cartridge detachably mountable on the main body of an electrophotographic apparatus, and integrally supporting the electrophotographic photosensitive member, and at least one unit selected from the group consisting of a charging unit, a developing unit and a cleaning unit.

According to further aspect of the present invention, there is provided an electrophotographic apparatus including the electrophotographic photosensitive member, a charging unit, an exposure unit, a developing unit and a transfer unit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The electrophotographic photosensitive member according to the present invention includes a support, an undercoat layer on the support, and a photosensitive layer on the undercoat layer. The photosensitive layer may be a photosensitive monolayer containing a charge generating material and a charge transport material in a single layer, or may be a photosensitive layer including a laminate of a charge generating layer containing a charge generating material and a charge transport layer containing a charge transport material. The photosensitive layer including a laminate is preferred.

Figure 2A:
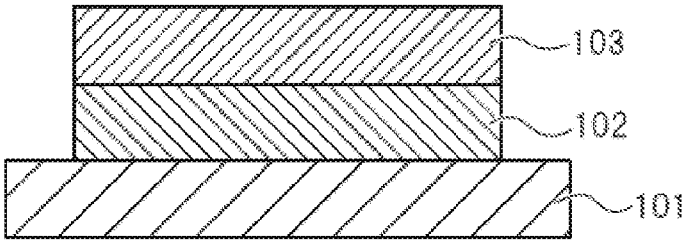
FIG. 2A is a diagram illustrating an example of the layer configuration of the electrophotographic photosensitive member.
Figure 2B:
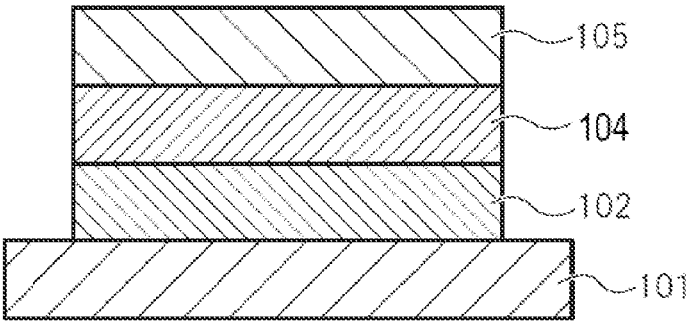
FIG. 2B is a diagram illustrating an example of the layer configuration of the electrophotographic photosensitive member.

Examples of the layer configuration of the electrophotographic photosensitive member according to the present invention are illustrated in FIGS. 2A and 2B. In FIG. 2A, 101 represents a support, 102 represents an undercoat layer and 103 represents a photosensitive layer. In FIG. 2B, 101 represents a support, 102 represents an undercoat layer, 104 represents an intermediate layer and 105 represents a photosensitive layer.

An undercoat layer of the electrophotographic photosensitive member according to the present invention includes a binder resin, and a complex particle composed of a core particle coated with tin oxide ($SnO_2$) doped with zinc, and the mass ratio of the complex particle to the binder resin is 1/1 or more. Hereinafter, the complex particle composed of a core particle coated with tin oxide doped with zinc is also referred to as "zinc-doped tin oxide-coated complex particle" or "complex particle."

Use of the electrophotographic photosensitive member according to the present invention prevents charging streaks in repeated formation of images under environments at low temperature and low humidity particularly with an increased process speed. The present inventors contemplate that charging streaks are prevented for the following reasons.

Hereinafter, a region before the charging region (region where the surface of the electrophotographic photosensitive member is charged by the charging unit) in the rotational direction of the electrophotographic photosensitive member is referred to as an upstream region of the charging region while a region after the charging region in the rotational direction of the electrophotographic photosensitive member is referred to as a downstream region of the charging region. First, after the surface of the electrophotographic photosensitive member is charged in the upstream region of the charging region, the amount of charge given in the upstream region to the electrophotographic photosensitive member decreases in the downstream region of the charging region. For this reason, portions sufficiently charged and portions not sufficiently charged are often intermingled on the surface of the electrophotographic photosensitive member. As a result, a difference in potential is generated on the surface of the electrophotographic photosensitive member (uneven charge). This difference in potential appears on the output image as image defects in the form of streaks (charging streaks) in the direction intersecting perpendicular to the circumferential direction of the surface of the electrophotographic photosensitive member.

One of possible causes to generate charging streaks is dielectric polarization. The dielectric polarization indicates a phenomenon that charges are lopsided in a dielectric substance disposed in an electric field. One of the dielectric polarization phenomena is orientation polarization caused by change of the orientations of dipole moments in the molecules forming the dielectric substance.

The relationship between orientation polarization and the surface potential of the electrophotographic photosensitive member will now be described in association with how the electric field applied to the electrophotographic photosensitive member changes during charging of the surface of the electrophotographic photosensitive member.

Charging of the surface of the electrophotographic photosensitive member in the upstream region of the charging region generates an electric field (hereinafter, referred to as "external electric field." The external electric field gradually causes polarization (orientation polarization) of the dipole moments inside the electrophotographic photosensitive member. The vector sum of the polarized dipole moment is the electric field (hereinafter, referred to as "internal electric field") generated inside the electrophotographic photosensitive member as a result of polarization. As the time passes, polarization progresses to increase the internal electric field. The direction of the vector of the internal electric field is opposite to that of the external electric field.

If a constant amount of charges is applied to the surface of the electrophotographic photosensitive member, the charges form a constant external electric field. In contrast, the internal electric field increases in the direction opposite to the external electric field as orientation polarization progresses. The total intensity of the electric field applied to the electrophotographic photosensitive member amounts to the sum of the intensities of the external electric field and the internal electric field. It is considered that the total intensity of the electric field gradually decreases as polarization progresses.

It is considered that the difference in potential is proportional with the intensity of the electric field during progression of orientation polarization. The total intensity of the electric field reducing with progression of orientation polarization causes a reduction in surface potential of the electrophotographic photosensitive member.

A dielectric loss tan δ is used as an index indicating the degree of progression of orientation polarization. The dielectric loss indicates heat loss of energy based on progression of orientation polarization in an alternating electric field, and is used as an index of time dependency of orientation polarization. A greater dielectric loss tan δ at a predetermined frequency indicates a larger degree of progression of orientation polarization in time corresponding to the frequency. A reduction in surface potential of the electrophotographic photosensitive member caused by progression of orientation polarization is affected by the degree of progression of polarization during the period of time from the start of charging of the surface of the electrophotographic photosensitive member in the upstream region of the charging region until charging thereof in the downstream region of the charging region (usually about $1.0\times10^{-3}$ seconds). If orientation polarization has not been completed within this time, orientation polarization progresses by charging of the surface of the electrophotographic photosensitive member in the downstream region of the charging region. As a result, it is considered that the surface potential of the electrophotographic photosensitive member is reduced.

Japanese Patent Application Laid-Open No. 2012-18371 discloses a technique of controlling the dielectric loss so as to reduce the dielectric loss to reduce charging streaks (horizontal charging streaks). Progression of orientation polarization is accelerated through a reduction in dielectric loss to prevent a reduction in surface potential in the downstream region of the charging region. In other words, charging is carried out in the upstream region of the charging region to quickly complete orientation polarization so as not to reduce the potential in the downstream region of the charging region. As a result, an effect of preventing charging streaks is attained.

The present inventors, who have conducted extensive research, have revealed that at a higher process speed there is room for prevention of generation of charging streaks. A higher process speed results in a shorter time during which the electrophotographic photosensitive member passes through the upstream region of the charging region. For this reason, the electrophotographic photosensitive member is required to be configured such that dielectric polarization in the upstream region of the charging region with a shorter time is completed so as not to decay the surface potential in the downstream region of the charging region. However, charging in the upstream region of the charging region may not be completed because of discharge deterioration of the charging member caused by repeated use. The present inventors have found that in such a case, a reduction in surface potential in the downstream region of the charging region causes discharge, readily generating charging streaks.

Unlike the conventional techniques of reducing the degree of dielectric polarization of the electrophotographic photosensitive member, the degree of dielectric polarization of the electrophotographic photosensitive member is increased in the present invention through use of a complex particle composed of a core particle coated with tin oxide doped with zinc in an undercoat layer. For this reason, the present inventors consider that the action to reduce charging streaks in the present invention is different from actions to reduce charging streaks in the related art. The present inventors consider that the degree of dielectric polarization in the undercoat layer containing the complex particle according to the present invention is intendedly increased to generate a sufficiently large decay in potential from the end of the upstream region of the charging region to the downstream region of the charging region compared to the decay generated by conventional techniques. Such a sufficiently large decay in potential of the electrophotographic photosensitive member generated at the end of the upstream region of the charging region can generate large discharge in the downstream region of the charging region to generate overall uniform discharge. The present inventors consider that as a result, the electrophotographic photosensitive member can be uniformly charged in the downstream region of the charging region to prevent generation of charging streaks. Moreover, use of the complex particle in the present invention barely decays the potential in the downstream region of the charging region and the following regions. The present inventors also consider that this feature contributes to prevention of generation of charging streaks.

If phosphorus, tungsten or antimony is used as a doping material, an increase in the amount of doping tends to reduce powder resistance. The prevent inventors have revealed that if zinc is used as a doping material, an increase in the amount of doping results in an increase in powder resistance. The same tendency is found if a zinc-doped tin oxide-coated titanium oxide particle is used in the undercoat layer. This suggests that the degree of dielectric polarization of the undercoat layer is increased. As a result, the potential from the end of the upstream region of the charging region to the downstream region of the charging region is largely decayed, reducing charging streaks (horizontal charging streaks) due to the action described above. The present inventors consider such a mechanism.

The support, the undercoat layer and the photosensitive layer included in the electrophotographic photosensitive member according to the present invention will now be described in detail.

<Support>

A support can have conductivity (conductive support). For example, a metal support formed with a metal or an alloy, such as aluminum, aluminum alloy or stainless steel can be used. If aluminum or an aluminum alloy is used, an aluminum tube produced by a production method including an extrusion step and a drawing step or an aluminum tube produced by a production method including an extrusion step and an ironing step can be used.

<Undercoat Layer>

The undercoat layer contains a binder resin, and a complex particle composed of a core particle coated with tin oxide doped with zinc. The undercoat layer can be formed as follows: a complex particle and a binder resin are dispersed in a solvent to prepare a coating solution for an undercoat layer, the coating solution is applied to form a coating, and the coating is dried and/or cured. Examples of the dispersion method include methods using paint shakers, sand mills, ball mills and solution-colliding high speed dispersing machines.

The undercoat layer can have a volume resistivity of $5.0\times10^{13}$ Ω·cm or less. An undercoat layer having a volume resistivity within this range prevents stagnation of charges during image formation to prevent residual potential. The undercoat layer has a volume resistivity of preferably $1.0\times10^{7}$ Ω·cm or more, more preferably $1.0\times10^{9}$ Ω·cm or more. An undercoat layer having a volume resistivity within this range causes an appropriate amount of charges to flow in the undercoat layer. As a result, dots or fogging is prevented during repeated formation of images under environments at high temperature and high humidity. A volume resistivity of $1.0\times10^{12}$ Ω·cm or more is particularly preferred because charging streaks in a high speed process are remarkably reduced.

(Core Particle)

Organic resin particles, inorganic particles and metal oxide particles are used as a core particle. The effect of preventing black spots under high voltage is higher in use of the zinc-doped tin oxide-coated complex particle according to the present invention containing such a core particle than in use of a tin oxide particle doped with zinc. An inorganic particle or a metal oxide particle can be used as the core particle in the present invention to be coated with tin oxide doped with zinc. A particle of a metal oxide other than tin oxide doped with zinc can be used as the metal oxide particle to form a complex particle. A preferred core particle is at least one selected from the group consisting of a zinc oxide particle, a titanium oxide particle, a barium sulfate particle and an aluminum oxide particle to prevent charging streaks. A more preferred core particle is at least one selected from the group consisting of the zinc oxide particle, the titanium oxide particle and the barium sulfate particle.

(Zinc-Doped Tin Oxide-Coated Complex Particle)

The core particle is coated with tin oxide doped with zinc to prepare a zinc-doped tin oxide-coated complex particle. Tin oxide ($SnO_2$) doped with zinc can be produced with reference to the methods described in National Publication of International Patent Application No. 2011-506700 and Japanese Patent Nos. 4105861 and 4301589, for example.

To adjust the volume resistivity of the undercoat layer to fall within the above range, the powder resistivity (powder specific resistance) of the zinc-doped tin oxide-coated complex particle is preferably $5.0\times10^{1}$ Ω·cm or more and $1.0\times10^{10}$ Ω·cm or less, more preferably $1.0\times10^{2}$ Ω·cm or more and $1.0\times10^{7}$ Ω·cm or less. The volume resistivity of the undercoat layer can be controlled within the above range through formation of the undercoat layer with a coating solution for an undercoat layer containing a zinc-doped tin oxide-coated complex particle having a powder resistivity within the above range. The powder resistivity within this range provides a higher effect of preventing charging streaks.

In the present invention, the powder resistivity of the zinc-doped tin oxide-coated complex particle is measured under an environment at normal temperature and normal humidity (23° C./50% RH). A resistometer (trade name: Loresta GP) manufactured by Mitsubishi Chemical Analytech, Co., Ltd. is used as a measurement apparatus in the present invention. The target complex particle is formed into pellets under pressure of 500 kg/cm$^2$, and these pellets are used as a sample for measurement. The voltage to be applied is 100 V.

The zinc-doped tin oxide-coated complex particle has a number average particle diameter of preferably 0.03 μm or more and 0.60 μm or less, more preferably 0.05 μm or more and 0.40 μm or less. A zinc-doped tin oxide-coated complex particle having a number average particle diameter within this range further prevents crack, and hence prevents local injection of charges into the photosensitive layer to reduce black spots.

In the present invention, the number average particle diameter D [μm] of the zinc-doped tin oxide-coated complex particle can be determined with a scanning electron microscope as follows. The target particles are observed with a scanning electron microscope (trade name: S-4800) manufactured by Hitachi, Ltd. In the obtained image, the particle diameters of 100 zinc-doped tin oxide-coated complex particles are measured. The arithmetic average of these particle diameters is calculated as a number average particle diameter D [μm]. Each particle diameter amounts to (a+b)/2 where a is defined as the longest side of a primary particle and b is defined as the shortest side.

The mass proportion (coating rate) of tin oxide to the zinc-doped tin oxide-coated complex particle is preferably 10% by mass or more and 60% by mass or less, more preferably 15% by mass or more and 55% by mass or less.

Control of the coating rate of tin oxide requires compounding of a tin raw material needed for generating tin oxide during production of the complex particle. For example, the coating rate of tin oxide is controlled in consideration of the amount of tin oxide ($SnO_2$) to be generated from a tin raw material tin chloride ($SnCl_4$). The coating rate of tin oxide is determined as a mass proportion of tin oxide in the total mass of the complex particle without considering the mass of zinc with which tin oxide is doped. A coating rate of tin oxide within this range facilitates control of the powder resistivity of the complex particle and uniform coating of the core particle with tin oxide.

The mass proportion of zinc (amount of doping) used in doping of tin oxide is preferably 0.001% by mass or more and 5% by mass or less, more preferably 0.01% by mass or more and 3.0% by mass or less of the mass of tin oxide (mass not including zinc). An amount of doping within this range increases the degree of dielectric polarization of the complex particle to provide a high effect of preventing charging streaks at a high process speed. Accumulation of residual potential can also be prevented.

(Binder Resin)

Examples of binder resins used in the undercoat layer include phenol resins, polyurethane resins, polyamides, polyimides, polyamideimides, poly(vinyl acetal) resins, epoxy resins, acrylic resins, melamine resin and polyester. These resins may be used singly or in combinations of two or more. Among these resins, curable resins can be used to prevent migration (bleed) into another layer (such as a photosensitive layer) and provide the dispersibility and the dispersion stability of the complex particle. Among these curable resins, phenol resins or polyurethane resins can be used because these resins cause appropriately large dielectric relaxation when these resins and the complex particle are dispersed.

In the present invention, the mass ratio (P/B) of the zinc-doped tin oxide-coated complex particle (P) to the binder resin (B) is 1/1 or more to prevent crack. A mass ratio within this range can increase the degree of dielectric polarization of the electrophotographic photosensitive member to provide a sufficient effect of preventing charging streaks. The mass ratio is preferably 1/1 or more and 4/1 or less. A mass ratio within this range facilitates control of the volume resistivity of the undercoat layer.

(Solvent)

Examples of solvents used in the coating solution for an undercoat layer include alcohols such as methanol, ethanol, isopropanol and 1-methoxy-2-propanol; ketones such as acetone, methyl ethyl ketone and cyclohexanone; ethers such as tetrahydrofuran, dioxane, ethylene glycol monomethyl ether and propylene glycol monomethyl ether; esters such as methyl acetate and ethyl acetate; and aromatic hydrocarbons such as toluene and xylene. These solvents may be used singly or in combinations of two or more.

The thickness of the undercoat layer is preferably 5 μm or more and 40 μm or less, more preferably 10 μm or more and 30 μm or less. In the present invention, the thicknesses of the layers included in the electrophotographic photosensitive member including the undercoat layer are determined with a measurement apparatus FISCHERSCOPE mms manufactured by Fischer Instruments K.K.

An undercoat layer according to the present invention containing the zinc-doped tin oxide-coated complex particle and further another tin oxide particle doped with zinc (hereinafter, also referred to as "zinc-doped tin oxide") has a higher effect of preventing pattern memory and an increase in bright potential. It is considered that this effect is provided because a non-coated zinc-doped tin oxide particle enters the gaps between places where electric conductive paths formed with the zinc-doped tin oxide-coated complex particle in the undercoat layer are disconnected, and as a result, facilitates formation of electric conductive paths.

If a zinc-doped tin oxide particle is mixed, the volume proportion of the zinc-doped tin oxide particle to the zinc-doped tin oxide-coated complex particle is preferably 0.1% by volume or more and 20% by volume or less. The volume proportion is more preferably 0.1% by volume or more and 10% by volume or less. At a volume proportion of the zinc-doped tin oxide particle of 20% by volume or less, zinc-doped tin oxide barely aggregates, and resistance is readily maintained. As a result, a local flow of the current is barely generated to further prevent leakage during charging.

The volume proportion of the zinc-doped tin oxide-coated complex particle and the zinc-doped tin oxide particle can be determined as follows: the undercoat layer included in the electrophotographic photosensitive member is extracted by an FIB method, and the volume proportion of the zinc-doped tin oxide-coated complex particle and the zinc-doped tin oxide particle is calculated with Slice & View of an FIB-SEM system. In other words, the zinc-doped tin oxide particle and the zinc-doped tin oxide-coated complex particle can be identified from the difference in contrast obtained with Slice & View of the FIB-SEM system, and the proportion of the volume of the zinc-doped tin oxide-coated complex particle and the volume of the zinc-doped tin oxide particle can be determined.

In the present invention, the conditions of Slice & View were set as follows:

Processing of a sample for analysis: FIB method
Apparatus for processing and observing the sample: NVision 40 manufactured by SII/Zeiss
Slice interval: 10 nm
Conditions of Observation:
Accelerating voltage: 1.0 kV
Inclination of the sample: 54°
WD: 5 mm
Detector: BSE detector
Aperture: 60 μm, high current
ABC: ON
Image resolution: 1.25 nm/pixel Analysis is performed in a region of 2 μm in length×2 μm in width. Information of each cross section is integrated to determine volumes $V_1$ (where $V_1$ indicates the volume of the zinc-doped tin oxide-coated complex particle) and $V_2$ (where $V_2$ indicates the volume of the zinc-doped tin oxide particle) per volume measuring 2 μm in length×2 μm in width×2 μm in thickness ($V_T$=8 $\mu m^3$). The measurement is performed under an environment at a temperature of 23° C. and a pressure of $1\times10^{-4}$ Pa. An apparatus for processing and observing the sample Strata 400S manufactured by FEI Company (inclination of the sample: 52°) can also be used.

Sampling was performed ten times in the same manner to obtain ten samples, and the ten samples were measured. The average of volumes $V_1$ per 8 $\mu m^3$ in ten points in total was divided by $V_T$ (8 $\mu m^3$), and the obtained value was defined as ($V_1/V_T$) of the undercoat layer of the target electrophotographic photosensitive member. The average of volumes $V_2$ per 8 $\mu m^3$ in ten points in total was divided by $V_T$ (8 $\mu m^3$), and the obtained value was defined as ($V_2/V_T$) of the undercoat layer of the target electrophotographic photosensitive member. From the information of each cross section, the area of each particle was obtained through image analysis. The image analysis was performed with the following image processing software.

Image Processing Software: Image-Pro Plus Manufactured by Media Cybernetics, Inc.

The undercoat layer may contain a surface roughening material to prevent interference fringes. Surface roughening materials are resin particles having an average particle diameter of preferably 1 μm or more and 5 μm or less, and more preferably 1 μm or more and 3 μm or less. Examples of the resin particles include particles of curable resins such as curable rubber, polyurethane, epoxy resins, alkyd resins, phenol resins, polyester, silicone resins and acrylic-melamine resins. Among these particles, particles of silicone resins, acrylic melamine resins and poly(methyl methacrylate) resins can be used. The content of the surface roughening material is preferably 1 to 80% by mass, more preferably 1 to 40% by mass relative to the binder resin contained in the undercoat layer.

The coating solution for an undercoat layer may contain a leveling agent such as silicone oil to enhance the surface properties of the undercoat layer. Furthermore, the undercoat layer may contain pigment particles to enhance the concealment of the undercoat layer.

<Intermediate Layer>

An intermediate layer may be disposed between the undercoat layer and the photosensitive layer to provide electrical barrier properties to block injection of charges from the undercoat layer to the photosensitive layer. The intermediate layer can be formed as follows: a coating solution for an intermediate layer containing a resin (binder resin) is applied onto an undercoat layer, and is dried.

(Resin)

Examples of the resin (binder resin) used in the intermediate layer include poly(vinyl alcohol), poly(vinyl methyl ether), polyacrylic acids, methyl cellulose, ethyl cellulose, poly(glutamic acid), polyamides, polyimides, polyamideimides, poly(amic acid), melamine resins, epoxy resins, polyurethane and poly(glutamic acid) esters. The intermediate layer can have a thickness of 0.1 μm or more and 2 μm or less.

The intermediate layer may contain a polymerized product of a composition containing an electron transporting material having a reactive functional group (polymerizable functional group) to improve a flow of charges from the photosensitive layer to the support. The polymerized product contained can prevent elution of the material for an intermediate layer into the solvent of the coating solution for a photosensitive layer during formation of the photosensitive layer on the intermediate layer. The polymerized product of a composition containing an electron transporting material having a reactive functional group can be prepared through polymerization of an electron transporting material having a reactive functional group and a resin having a reactive functional group (polymerizable functional group) using a crosslinking agent.

(Electron Transporting Material)

Examples of the electron transporting material include quinone compounds, imide compounds, benzimidazole compounds and cyclopentadienylidene compounds. Examples of the reactive functional group include a hydroxy group, a thiol group, an amino group, a carboxyl group or a methoxy group. The content of the electron transporting material having a reactive functional group can be 30% by mass or more and 70% by mass or less in the composition containing the electron transporting material having a reactive functional group in the intermediate layer. Specific examples of the electron transporting material having a reactive functional group are shown below:

(A1)

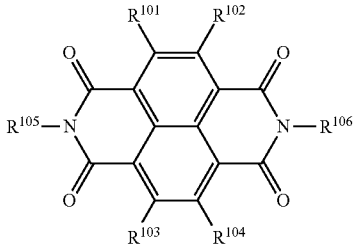

(A2)

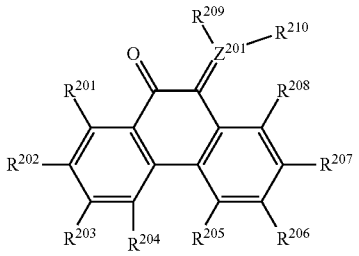

(A3)

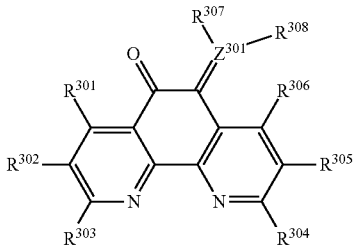

(A4)

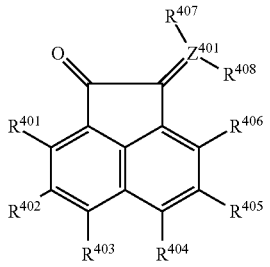

-continued (A5)

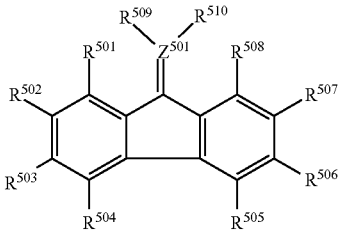

(A6)

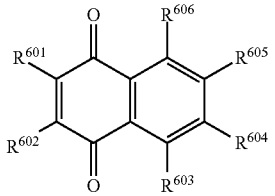

(A7)

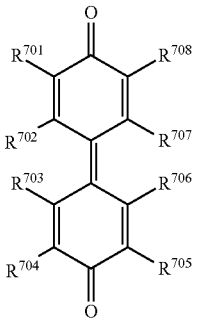

(A8)

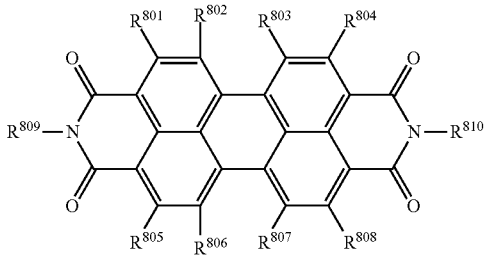

(A9)

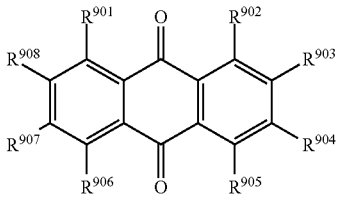

(A10)

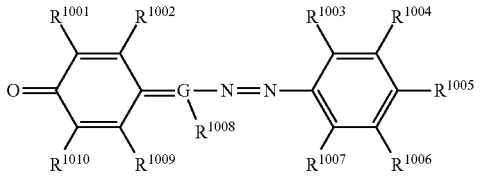

-continued (A11)

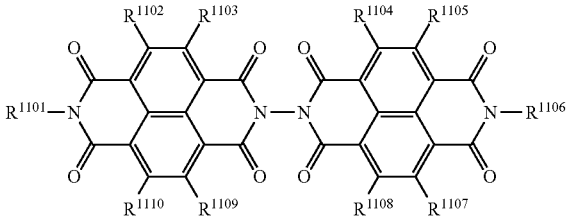

(A12)

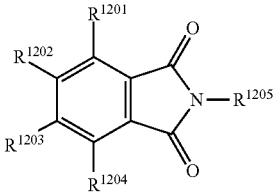

(A13)

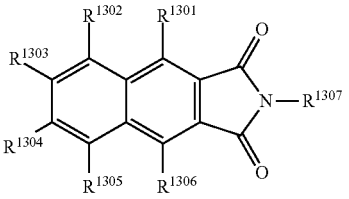

(A14)

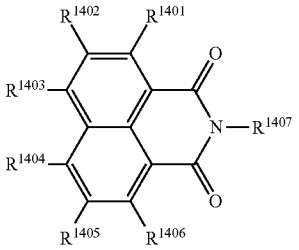

(A15)

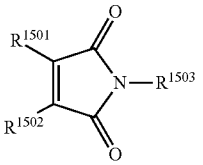

(A16)

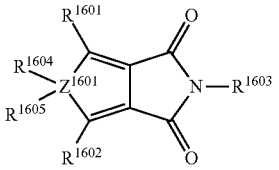

(A17)

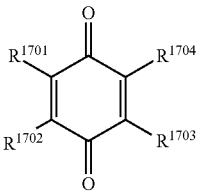

where $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$, $R^{901}$ to $R^{908}$, $R^{1001}$ to $R^{1010}$, $R^{1101}$ to $R^{1110}$, $R^{1201}$ to $R^{1205}$, $R^{1301}$ to $R^{1307}$, $R^{1401}$ to $R^{1407}$, $R^{1501}$ to $R^{1503}$, $R^{1601}$ to $R^{1605}$, and $R^{1701}$ to $R^{1704}$ each independently represent a monovalent group represented by the following formula (1) or (2), a hydrogen atom, a cyano group, a nitro group, a halogen atom, an alkoxycarbonyl group, a substituted or unsubstituted alkyl group, a substituted or unsubstituted aryl group, or a substituted or unsubstituted heterocycle; the substituent of the substituted alkyl group is an alkyl group, an aryl group, a halogen atom or a carbonyl group; the substituent of the substituted aryl group or the substituted heterocyclic group is a halogen atom, a nitro group, a cyano group, an alkyl group, a halogen-substituted alkyl group, an alkoxy group or a carbonyl group;

$Z^{201}$, $Z^{301}$, $Z^{401}$, $Z^{501}$ and $Z^{1601}$ each independently represent a carbon atom, a nitrogen atom or an oxygen atom; when $Z^{201}$ is an oxygen atom, $R^{209}$ and $R^{210}$ are not present; when $Z^{201}$ is a nitrogen atom, $R^{210}$ is not present; when $Z^{301}$ is an oxygen atom, $R^{307}$ and $R^{308}$ are not present; when $Z^{301}$ is a nitrogen atom, $R^{308}$ is not present; when $Z^{401}$ is an oxygen atom, $R^{407}$ and $R^{408}$ are not present; when $Z^{401}$ is a nitrogen atom, $R^{408}$ is not present; when $Z^{501}$ is an oxygen atom, $R^{509}$ and $R^{510}$ are not present; when $Z^{501}$ is a nitrogen atom, $R^{510}$ is not present; when $Z^{1601}$ is an oxygen atom, $R^{1604}$ and $R^{1605}$ are not present; and when $Z^{1601}$ is a nitrogen atom, $R^{1605}$ is not present.

At least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, at least one of $R^{801}$ to $R^{810}$, at least one of $R^{901}$ to $R^{908}$, at least one of $R^{1001}$ to $R^{1010}$, at least one of $R^{1101}$ to $R^{1110}$, at least one of $R^{1201}$ to $R^{1205}$, at least one of $R^{1301}$ to $R^{1307}$, at least one of $R^{1401}$ to $R^{1407}$, at least one of $R^{1501}$ to $R^{1503}$, at least one of $R^{1601}$ to $R^{1605}$, and at least one of $R^{1701}$ to $R^{1704}$ are each a group represented by the following formula (1) or (2). If a plurality of groups represented by the following formula (1) is present in one compound, the plurality of A in the formula (1) may be the same or different. If a plurality of groups represented by the following formula (2) is present in one compound, a plurality of B, a plurality of C, and a plurality of D in the formula (2) may be the same or different.

$$-A \quad (1)$$

$$-(B)_l-C-D \quad (2)$$

where at least one of A, B, C and D is a carboxyl group, an amino group, or a group having a substituent, and the substituent is at least one group selected from the group consisting of a hydroxy group, a thiol group, an amino group, a carboxyl group and a methoxy group.

"A" represents a carboxyl group, an amino group, an alkyl group having 1 to 6 carbon atoms, an alkyl group having a main chain having 1 to 6 carbon atoms substituted with an alkyl group having 1 to 6 carbon atoms, an alkyl group having a main chain having 1 to 6 carbon atoms substituted with a benzyl group, or an alkyl group having a main chain having 1 to 6 carbon atoms substituted with a phenyl group. When "A" is the above-listed alkyl group excluding a carboxyl group and an amino group, the alkyl group has at least one substituent selected from the group consisting of a hydroxy group, a thiol group, an amino group, a carboxyl group and a methoxy group. One of the carbon atoms in the main chain of the alkyl group may be replaced with O or $NR^1$ where $R^1$ is a hydrogen atom or an alkyl group.

"B" represents an alkylene group having a main chain having 1 to 6 carbon atoms, an alkylene group having a main chain having 1 to 6 carbon atoms substituted with an alkyl group having 1 to 6 carbon atoms, an alkylene group having a main chain having 1 to 6 carbon atoms substituted with a benzyl group, an alkylene group having a main chain having 1 to 6 carbon atoms substituted with an alkoxycarbonyl group, or an alkylene group having a main chain having 1 to 6 carbon atoms substituted with a phenyl group. These groups may have at least one substituent selected from the group consisting of a hydroxy group, a thiol group, an amino group, a carboxyl group and a methoxy group. One of the carbon atoms in the main chain of the alkylene group may be replaced with 0 or $NR^2$ where $R^2$ is a hydrogen atom or an alkyl group.

"l" is 0 or 1.

"C" represents a phenylene group, a phenylene group substituted with an alkyl group having 1 to 6 carbon atoms, a phenylene group substituted with a nitro group, a phenylene group substituted with a halogen group, a phenylene group substituted with an alkoxy group having 1 to 6 carbon atoms, an alkyl group having a main chain having 1 to 6 carbon atoms substituted with a benzyl group, or an alkyl group having a main chain having 1 to 6 carbon atoms substituted with a phenyl group. These groups may have at least one substituent selected from the group consisting of a hydroxy group, a thiol group, an amino group, a carboxyl group and a methoxy group.

"D" represents a hydrogen atom, an alkyl group having 1 to 6 carbon atoms, or an alkyl group having a main chain having 1 to 6 carbon atoms substituted with an alkyl group having 1 to 6 carbon atoms. These groups may have at least one substituent selected from the group consisting of a hydroxy group, a thiol group, an amino group, a carboxyl group and a methoxy group. When "D" is a hydrogen atom, the hydrogen atom is the hydrogen atom contained in the structure of C.

Specific examples of the electron transporting material having a reactive functional group are shown below. Specific examples of the compounds represented by the formulae (A1) to (A17) are shown in Tables 1 to 18. In the following tables, if one compound contains two groups represented by the formula (1) and these two groups A in the formula (1) are different, one of the groups A is shown as (1), and the other is shown as (1)'. Similarly, if one compound contains two groups represented by the formula (2) and the two groups of B, C and D in the formula (2) are different, one of the groups is shown as (2), and the other is shown as (2)'.

TABLE 1

| Exemplified compound | $R^{101}$ | $R^{102}$ | $R^{103}$ | $R^{104}$ | $R^{105}$ | $R^{106}$ | (1) A | (2) B | C | D |
|---|---|---|---|---|---|---|---|---|---|---|
| A101 | H | H | H | H | 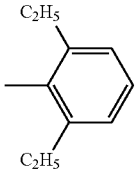 | (1) | 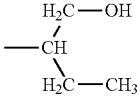 | — | — | — |

TABLE 1-continued
| Exemplified compound | $R^{101}$ | $R^{102}$ | $R^{103}$ | $R^{104}$ | $R^{105}$ | $R^{106}$ | (1) A | (2) B | (2) C | (2) D |
|---|---|---|---|---|---|---|---|---|---|---|
| A102 | H | H | H | H | 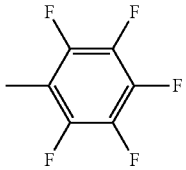 | (1) | —COOH | — | — | — |
| A103 | CN | H | H | CN | 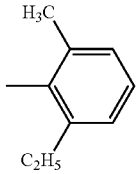 | (2) | — | — | 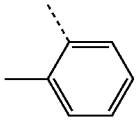 | 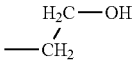 |
| A104 | H | $NO_2$ | H | $NO_2$ | 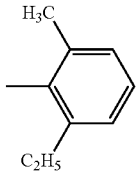 | (1) | 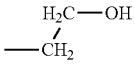 | — | — | — |
| A105 | F | H | H | F | (2) | (2) | — | — | 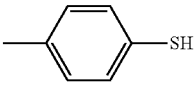 | H |
| A106 | H | H | H | H | 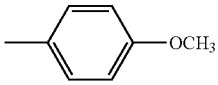 | (2) | — | — | 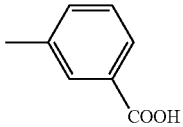 | H |
| A107 | H | H | H | H | 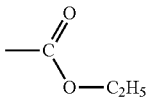 | (2) | — | — | 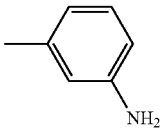 | H |
| A108 | H | H | H | H | 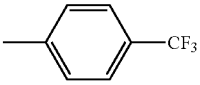 | (2) | — | — | 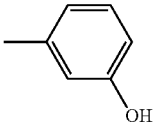 | H |
| A109 | H | H | H | H | 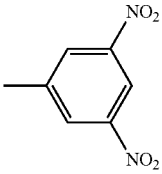 | (2) | — | — | 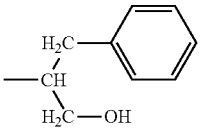 | H |
| A110 | H | H | H | H | 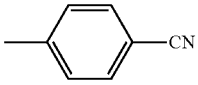 | (2) | — | — | 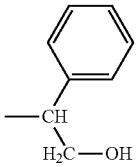 | H |

TABLE 2
| Exemplified compound | $R^{101}$ | $R^{102}$ | $R^{103}$ | $R^{104}$ | $R^{105}$ | $R^{106}$ | (1) A |
|---|---|---|---|---|---|---|---|
| A111 | H | H | H | H | 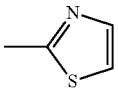 | (1) | 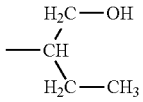 |
| A112 | H | H | H | H | 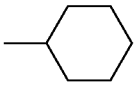 | (1) | 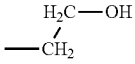 |
| A113 | H | H | H | H | 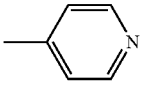 | (2) | — |
| A114 | H | H | H | H | 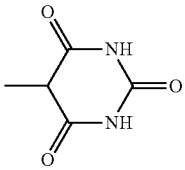 | (2) | — |
| A115 | H | H | H | H | (1) | (2) | $—C_2H_4—O—C_2H_5$ |
| A116 | H | H | H | H | 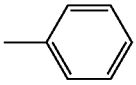 | (1) | $—(CH_2)_5—OH$ |
| A117 | H | H | H | H | (2) | (2) | — |
| A118 | H | H | H | H | (2) | (1) | 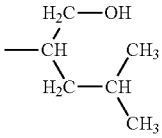 |
| A119 | H | H | H | H | (1) | (1) | 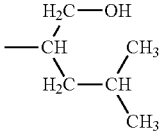 |
| A120 | H | H | H | H | (1) | (1)' | 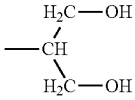 |
| Exemplified compound | (2) B | (2) C | (2) D | (1)' A |
|---|---|---|---|---|
| A111 | — | — | — | — |
| A112 | — | — | — | — |
| A113 | $—CH_2CH_2$---- | 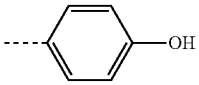 | H | — |
| A114 | — | 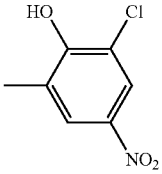 | H | — |

TABLE 2-continued
| | | | | |
|---|---|---|---|---|
| A115 | — | 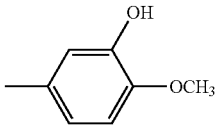 | H | — |
| A116 | — | — | — | — |
| A117 | — | 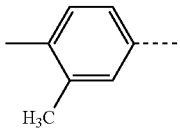 | 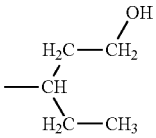 | — |
| A118 | — | 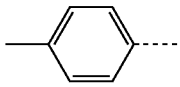 | 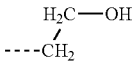 | — |
| A119 | — | — | — | — |
| A120 | — | — | — | 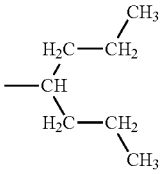 |
TABLE 3
| Exemplified compound | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ |
|---|---|---|---|---|---|---|---|---|---|---|---|
| A201 | H | (1) | H | H | H | H | (2) | H | — | — | O |
| A202 | H | (2) | H | H | H | H | (1) | H | — | — | O |
| A203 | H | (2) | H | H | H | H | (1) | H | — | — | O |
| A204 | $CH_3$ | H | H | H | H | H | H | $CH_3$ | (2) | — | N |
| A205 | H | Cl | H | H | H | H | Cl | H | (2) | — | N |
| A206 | H | H | 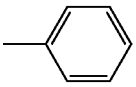 | H | H | 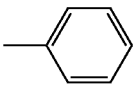 | H | H | (2) | — | N |
| A207 | H | H | 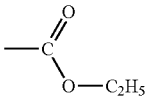 | H | H | 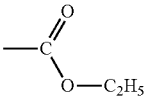 | H | H | (2) | — | N |
| A208 | H | H | (2) | H | H | (2) | H | H | CN | CN | C |
| A209 | H | H | (2) | H | H | (2) | H | H | CN | CN | C |
| Exemplified compound | (1) A | (2) B | (2) C | (2) D |
|---|---|---|---|---|
| A201 | 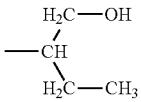 | — | 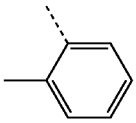 | ----$CH_2$—OH |
| A202 | —$(CH_2)_5$—OH | — | 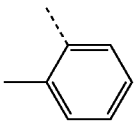 | ----$CH_2$—OH |

TABLE 3-continued
| | | | | |
|---|---|---|---|---|
| A203 | —C(H$_2$)—COOH | — | 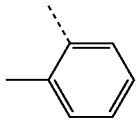 | ----C(H$_2$)—COOH |
| A204 | — | — | 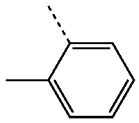 | H$_2$C—OH / ----CH$_2$ |
| A205 | — | — | 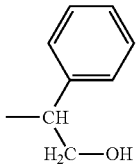 | H |
| A206 | — | — | 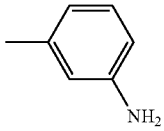 | H |
| A207 | — | — | 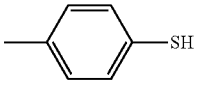 | H |
| A208 | — | — | 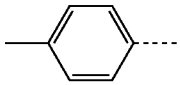 | ----CH$_2$—OH |
| A209 | — | —CH$_2$CH$_2$--- | 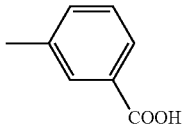 | H |
40
TABLE 4
| Exemplified compound | $R^{301}$ | $R^{302}$ | $R^{303}$ | $R^{304}$ | $R^{305}$ | $R^{306}$ | $R^{307}$ | $R^{308}$ |
|---|---|---|---|---|---|---|---|---|
| A301 | H | (1) | H | H | (2) | H | — | — |
| A302 | H | (2) | H | H | (1) | H | — | — |
| A303 | H | (2) | H | H | (1) | H | — | — |
| A304 | H | H | H | H | H | H | (2) | — |
| A305 | H | Cl | H | H | Cl | H | (2) | — |
| A306 | H | H | 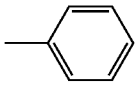 | 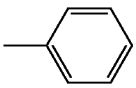 | H | H | (2) | — |
| A307 | H | H | 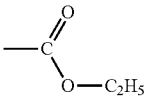 | 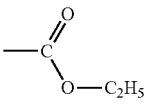 | H | H | (2) | — |
| A308 | H | H | (2) | (2) | H | H | CN | CN |
| A309 | H | H | (2) | (2) | H | H | CN | CN |

TABLE 4-continued
| Exemplified compound | $Z^{301}$ | (1) A | (2) B | (2) C | (2) D |
|---|---|---|---|---|---|
| A301 | O | $H_2C—OH$ / —CH \ $H_2C—CH_3$ | — | 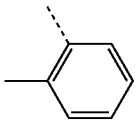 | ----$CH_2$—OH |
| A302 | O | —$(CH_2)_5$—OH | — | 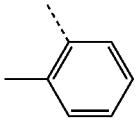 | ----$CH_2$—OH |
| A303 | O | —C($H_2$)—COOH | — | 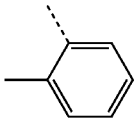 | ----C($H_2$)—COOH |
| A304 | N | — | — | 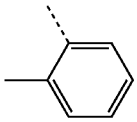 | $H_2C—OH$ / ----$CH_2$ |
| A305 | N | — | — | 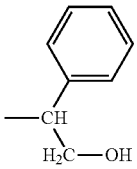 | H |
| A306 | N | — | — | 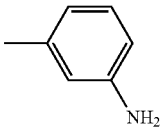 | H |
| A307 | N | — | — | 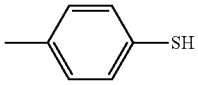 | H |
| A308 | C | — | — | 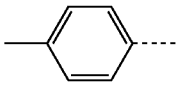 | ----$CH_2$—OH |
| A309 | C | — | ----$CH_2$—OH | 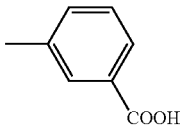 | H |
TABLE 5
| Exemplified compound | $R^{401}$ | $R^{402}$ | $R^{403}$ | $R^{404}$ | $R^{405}$ | $R^{406}$ | $R^{407}$ | $R^{408}$ |
|---|---|---|---|---|---|---|---|---|
| A401 | H | Cl | H | H | Cl | H | (2) | — |
| A402 | H | H | 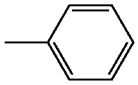 | 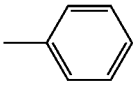 | H | H | (2) | — |

TABLE 5-continued
| | | | | | | | | |
|---|---|---|---|---|---|---|---|---|
| A403 | H | H | 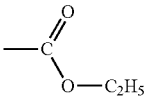 | 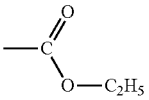 | H | H | (2) | — |
| A404 | H | H | (2) | (2) | H | H | — | — |
| A405 | H | H | (2) | (2) | H | H | — | — |
| A406 | H | H | (2) | (2) | H | H | — | — |
| A407 | H | H | (1) | (1) | H | H | CN | CN |
| A408 | H | H | (1) | (1) | H | H | CN | CN |
| A409 | H | H | (1) | (1) | H | H | CN | CN |
| Exemplified compound | $Z^{401}$ | (1) A | (2) B | (2) C | (2) D |
|---|---|---|---|---|---|
| A401 | N | — | — | 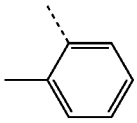 | 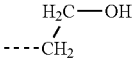 |
| A402 | N | — | — | 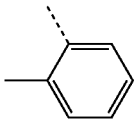 | 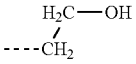 |
| A403 | N | — | — | 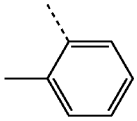 | 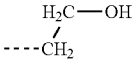 |
| A404 | O | — | — | 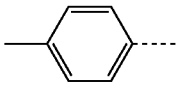 | ----$CH_2$—OH |
| A405 | O | — | — | 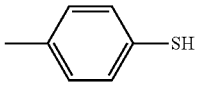 | H |
| A406 | O | — | —$CH_2CH_2$---- | 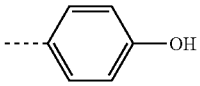 | H |
| A407 | C | 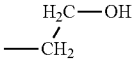 | — | — | — |
| A408 | C | COOH | — | — | — |
| A409 | C | $NH_2$ | — | — | — |
TABLE 6
| Exemplified compound | $R^{501}$ | $R^{502}$ | $R^{503}$ | $R^{504}$ | $R^{505}$ | $R^{506}$ | $R^{507}$ | $R^{508}$ | $R^{509}$ |
|---|---|---|---|---|---|---|---|---|---|
| A501 | H | (2) | H | H | H | H | (2) | H | — |
| A502 | H | (2) | H | H | H | H | (2) | H | — |
| A503 | H | (2) | H | H | H | H | (2) | H | — |
| A504 | H | (2) | H | H | H | H | (2) | H | 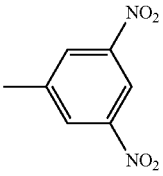 |

TABLE 6-continued
| | | | | | | | | | |
|---|---|---|---|---|---|---|---|---|---|
| A505 | H | H | H | H | H | H | H | H | (1) |
| A506 | $CH_3$ | H | H | H | H | H | H | $CH_3$ | (2) |
| A507 | H | (1) | H | H | H | H | (1) | H | CN |
| A508 | H | H | (2) | H | H | (2) | H | H | CN |
| A509 | H | (2) | H | H | H | H | (2) | H | CN |
| Exemplified | | | (1) | (2) | | |
|---|---|---|---|---|---|---|
| compound | $R^{510}$ | $Z^{501}$ | A | B | C | D |
| A501 | — | O | — | — | 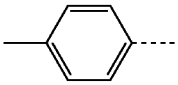 | ----$CH_2$—OH |
| A502 | — | O | — | — | 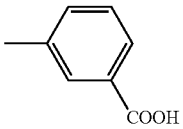 | H |
| A503 | — | O | — | — | 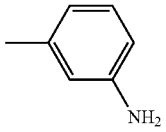 | H |
| A504 | — | N | — | — | 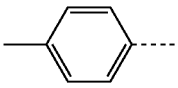 | ----$CH_2$—OH |
| A505 | — | N | 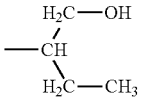 | — | — | — |
| A506 | — | N | — | — | 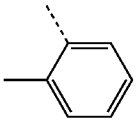 | 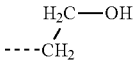 |
| A507 | CN | C | $NH_2$ | — | — | — |
| A508 | CN | C | — | — | 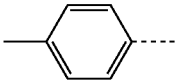 | ----$CH_2$—OH |
| A509 | CN | C | — | —$CH_2CH_2$---- | 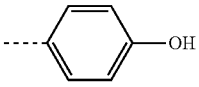 | H |
50
TABLE 7
| Exemplified | | | | | | | (1) | (2) | | |
|---|---|---|---|---|---|---|---|---|---|---|
| compound | $R^{601}$ | $R^{602}$ | $R^{603}$ | $R^{604}$ | $R^{605}$ | $R^{606}$ | A | B | C | D |
| A601 | (2) | H | H | H | H | H | — | — | 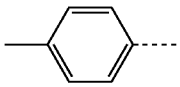 | ----$CH_2$—OH |
| A602 | (2) | H | H | H | H | H | — | — | 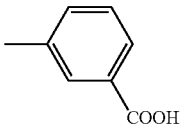 | H |

TABLE 7-continued
| Exemplified compound | $R^{601}$ | $R^{602}$ | $R^{603}$ | $R^{604}$ | $R^{605}$ | $R^{606}$ | (1) A | (2) B | (2) C | (2) D |
|---|---|---|---|---|---|---|---|---|---|---|
| A603 | (2) | H | H | H | H | H | — | — | 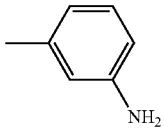 | H |
| A604 | (2) | H | H | H | H | H | — | — | 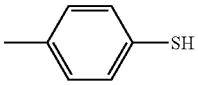 | H |
| A605 | (2) | H | H | H | H | H | — | —$CH_2CH_2$---- | 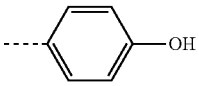 | H |
| A606 | (1) | H | H | H | H | H | 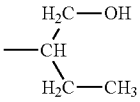 | — | — | — |
| A607 | CN | CN | (1) | H | H | H | $NH_2$ | — | — | — |
| A608 | (2) | (2) | H | H | H | H | — | — | 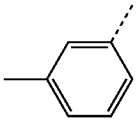 | ----$CH_2$—OH |
| A609 | (1) | (1) | H | H | H | H | 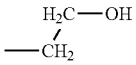 | — | — | — |
| A610 | (1) | (1) | H | H | H | H | COOH | — | — | — |
TABLE 8
| Exemplified compound | $R^{701}$ | $R^{702}$ | $R^{703}$ | $R^{704}$ | $R^{705}$ | $R^{706}$ | $R^{707}$ | $R^{708}$ | (1) A | (2) B | (2) C | (2) D |
|---|---|---|---|---|---|---|---|---|---|---|---|---|
| A701 | (1) | H | H | H | (2) | H | H | H | 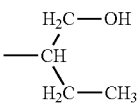 | — | 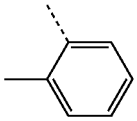 | ----$CH_2$—OH |
| A702 | (2) | H | H | H | (1) | H | H | H | —$(CH_2)_5$—OH | — | 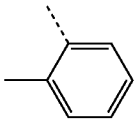 | ----$CH_2$—OH |
| A703 | (2) | H | H | H | (1) | H | H | H | —$CH_2$—COOH | — | 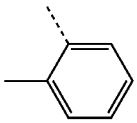 | ----$CH_2$—COOH |
| A704 | (2) | H | H | H | H | H | H | H | — | — | 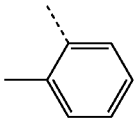 | 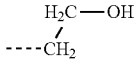 |

TABLE 8-continued
| Exemplified compound | $R^{701}$ | $R^{702}$ | $R^{703}$ | $R^{704}$ | $R^{705}$ | $R^{706}$ | $R^{707}$ | $R^{708}$ | (1) A | (2) B | (2) C | (2) D |
|---|---|---|---|---|---|---|---|---|---|---|---|---|
| A705 | (2) | H | H | H | H | H | H | H | — | — | 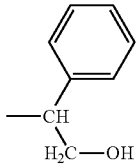 | H |
| A706 | (2) | H | H | H | H | H | H | H | — | — | 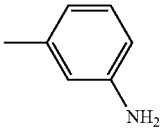 | H |
| A707 | (2) | H | H | H | H | H | H | H | — | — | 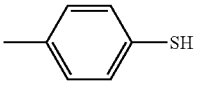 | H |
| A708 | (2) | H | H | H | (2) | H | H | H | — | — | 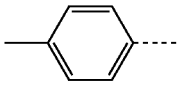 | ----$CH_2$—OH |
| A709 | (2) | H | H | H | (2) | H | H | H | — | —$CH_2CH_2$---- | 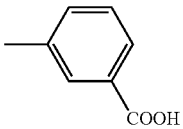 | H |
TABLE 9
| Exemplified compound | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | (1) A | (2) B |
|---|---|---|---|---|---|---|---|---|---|---|---|---|
| A801 | H | H | H | H | H | H | H | H | (1) | (1)' | 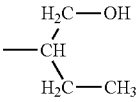 | — |
| A802 | H | H | H | H | H | H | H | H | (2) | (1) | $-(CH_2)_5-OH$ | — |
| A803 | H | H | H | H | H | H | H | H | (2) | (1) | $-C(H_2)-COOH$ | — |
| A804 | H | H | H | H | H | H | H | H | (2) | (2)' | — | — |
| A805 | H | Cl | Cl | H | H | Cl | Cl | H | 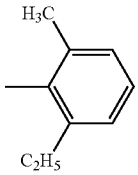 | (1) | 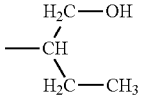 | — |
| A806 | H | H | H | H | H | H | H | H | 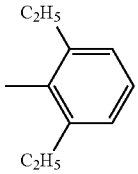 | (2) | — | — |

TABLE 9-continued
| | | | | | | | | | | | | |
|---|---|---|---|---|---|---|---|---|---|---|---|---|
| A807 | H | H | H | H | H | H | H | H | $C_2H_5$ 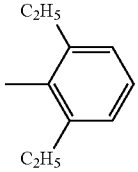 $C_2H_5$ | (2) | — | — |
| A808 | H | H | H | H | H | H | H | H | (2) | (2) | — | —$CH_2CH_2$---- |
| A809 | H | H | H | H | H | H | H | H | (2) | (1) | $H_2C$—OH / —CH \ $H_2C$—CH / $CH_3$ \ $CH_3$ | — |
| A810 | H | H | H | H | H | H | H | H | (1) | (1) | $H_2C$—OH / —CH \ $H_2C$—CH / $CH_3$ \ $CH_3$ | — |
| A811 | H | H | H | H | H | H | H | H | (1) | (1)' | $H_2C$—OH / —CH \ $H_2C$—OH | — |
| Exemplified compound | (2) | | (1)' | (2)' | | |
|---|---|---|---|---|---|---|
| | C | D | A | B | C | D |
| A801 | — | — | —$(CH_2)_5$—OH | — | — | — |
| A802 | 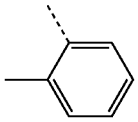 | ----$CH_2$—OH | — | — | — | — |
| A803 | 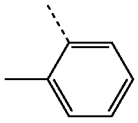 | | — | — | — | — |
| A804 | 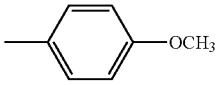 $OCH_3$ | H | — | — | 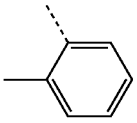 | ----$CH_2$—OH |
| A805 | — | — | — | — | — | — |
| A806 | 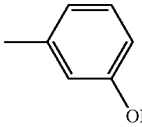 OH | H | — | — | — | — |
| A807 | 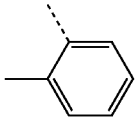 | $H_2C$—OH / ----$CH_2$ | — | — | — | — |

TABLE 9-continued
| | | | | | |
|---|---|---|---|---|---|
| A808 | 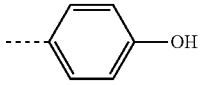 | H | — | — | — | — |
| A809 | 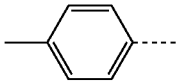 | 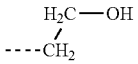 | — | — | — | — |
| A810 | — | — | — | — | — | — |
| A811 | — | — | 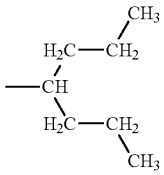 | — | — | — |
TABLE 10
| Exemplified compound | $R^{901}$ | $R^{902}$ | $R^{903}$ | $R^{904}$ | $R^{905}$ | $R^{906}$ | $R^{907}$ | $R^{908}$ | (1) A | (2) B | (2) C | (2) D |
|---|---|---|---|---|---|---|---|---|---|---|---|---|
| A901 | (1) | H | H | H | H | H | H | H | $—CH_2—OH$ | — | — | — |
| A902 | (1) | H | H | H | H | H | H | H | $—(CH_2)_2—OH$ | — | — | — |
| A903 | (2) | H | H | H | (1) | H | H | H | $—CH_2—COOH$ | $—CH_2CH_2$---- | 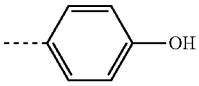 | H |
| A904 | (1) | H | H | H | (2) | H | H | H | $—(CH_2)_2—OH$ | — | 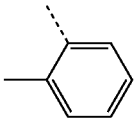 | ----$CH_2$—OH |
| A905 | H | H | H | H | H | H | H | (2) | — | — | 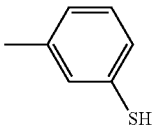 | H |
| A906 | H | H | H | H | H | H | H | (2) | — | — | 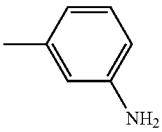 | H |
| A907 | H | H | H | H | H | H | H | (2) | — | — | 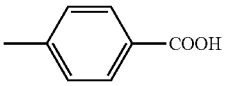 | H |
| A908 | H | CN | H | H | H | H | CN | (2) | — | — | 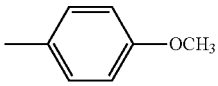 | H |
| A909 | (2) | H | H | H | (2) | H | H | H | — | — | 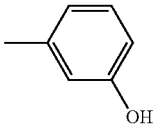 | H |

TABLE 10-continued
| Exemplified compound | $R^{901}$ | $R^{902}$ | $R^{903}$ | $R^{904}$ | $R^{905}$ | $R^{906}$ | $R^{907}$ | $R^{908}$ | (1) A | (2) B | (2) C | (2) D |
|---|---|---|---|---|---|---|---|---|---|---|---|---|
| A910 | (1) | H | H | (2) | H | H | H | H | $-(CH_2)_2-OH$ | — | 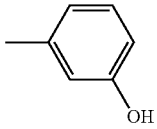 | H |
| A911 | H | (2) | H | H | H | H | H | (1) | $-(CH_2)_6-OH$ | — | 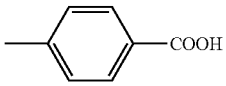 | H |
TABLE 11
| Exemplified compound | $R^{1001}$ | $R^{1002}$ | $R^{1003}$ | $R^{1004}$ | $R^{1005}$ | $R^{1006}$ | $R^{1007}$ | $R^{1008}$ | $R^{1009}$ |
|---|---|---|---|---|---|---|---|---|---|
| A1001 | 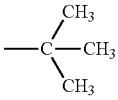 | H | H | H | H | (1) | H | H | H |
| A1002 | 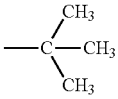 | H | H | H | H | (2) | H | H | H |
| A1003 | 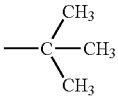 | H | H | H | H | (2) | H | H | H |
| A1004 | 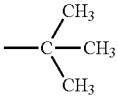 | H | H | H | H | (2) | H | H | H |
| A1005 | 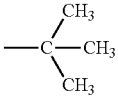 | H | H | H | H | (2) | H | H | H |
| A1006 | 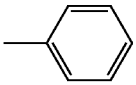 | H | H | H | H | (1) | H | H | H |
| A1007 | 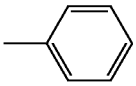 | H | H | H | H | (2) | H | H | H |
| A1008 | 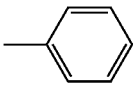 | H | H | H | H | (2) | H | H | H |
| A1009 | 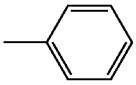 | H | H | H | H | (2) | H | H | H |
| A1010 | 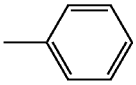 | H | H | H | H | (2) | H | H | H |

TABLE 11-continued
| Exemplified compound | $R^{1010}$ | (1) A | (2) B | (2) C | (2) D |
|---|---|---|---|---|---|
| A1001 | 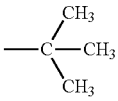 | —$CH_2$—OH | — | — | — |
| A1002 | 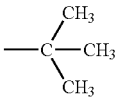 | — | — | 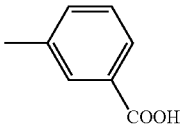 | H |
| A1003 | 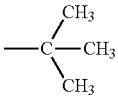 | — | —$CH_2CH_2$---- | 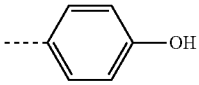 | H |
| A1004 | 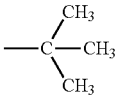 | — | — | 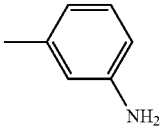 | H |
| A1005 | 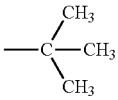 | — | — | 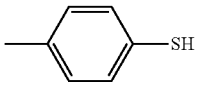 | H |
| A1006 | 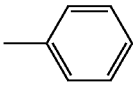 | —$CH_2$—OH | — | — | — |
| A1007 | 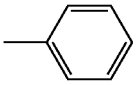 | — | — | 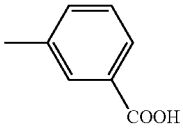 | H |
| A1008 | 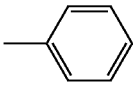 | — | —$CH_2CH_2$---- | 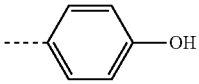 | H |
| A1009 | 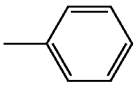 | — | — | 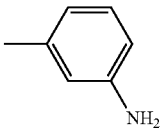 | H |
| A1010 | 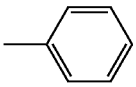 | — | — | 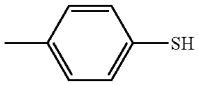 | H |

TABLE 12
| Exemplified compound | $R^{1101}$ | $R^{1102}$ | $R^{1103}$ | $R^{1104}$ | $R^{1105}$ | $R^{1106}$ | $R^{1107}$ | $R^{1108}$ | $R^{1109}$ | $R^{1110}$ | (1) A | (2) B |
|---|---|---|---|---|---|---|---|---|---|---|---|---|
| A1101 | (1) | H | H | H | H | (1) | H | H | H | H | 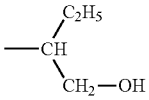 | — |
| A1102 | (2) | H | H | H | H | (1) | H | H | H | H | $-(CH_2)_5-OH$ | — |
| A1103 | (2) | H | H | H | H | (1) | H | H | H | H | $-CH_2-COOH$ | — |
| A1104 | (2) | H | H | H | H | (2)' | H | H | H | H | — | — |
| A1105 | 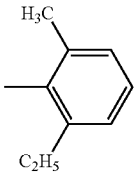 | H | Cl | Cl | H | (1) | H | Cl | Cl | H | 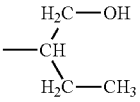 | — |
| A1106 | 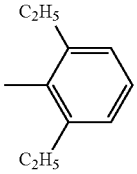 | H | H | H | H | (2) | H | H | H | H | — | — |
| A1107 | 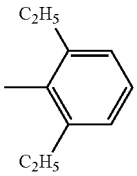 | H | H | H | H | (2) | H | H | H | H | — | — |
| A1108 | (2) | H | H | H | H | (2) | H | H | H | H | — | $-CH_2CH_2$---- |
| A1109 | (2) | H | H | H | H | (1) | H | H | H | H | 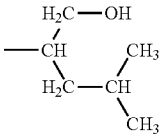 | — |
| A1110 | (1) | H | H | H | H | (1) | H | H | H | H | 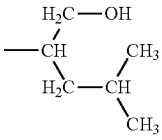 | — |
| A1111 | (1) | H | H | H | H | (1)' | H | H | H | H | 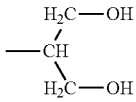 | — |

TABLE 12-continued
| Exemplified compound | (2) C | (2) D | (1)' A | (2)' B | (2)' C | (2)' D |
|---|---|---|---|---|---|---|
| A1101 | — | — | — | — | — | — |
| A1102 | 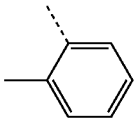 | ----$CH_2$—OH | — | — | — | — |
| A1103 | 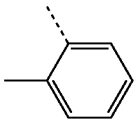 | ----C($H_2$)—COOH | — | — | — | — |
| A1104 | 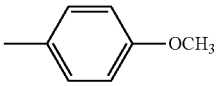 | H | — | — | 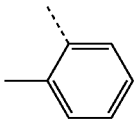 | ----$CH_2$—OH |
| A1105 | — | — | — | — | — | — |
| A1106 | 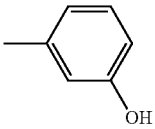 | H | — | — | — | — |
| A1107 | 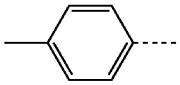 | ----C($H_2$)—COOH | — | — | — | — |
| A1108 | 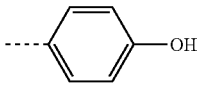 | H | — | — | — | — |
| A1109 | 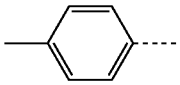 | $H_2C$—OH / ----$CH_2$ | — | — | — | — |
| A1110 | — | — | — | — | — | — |
| A1111 | — | — | 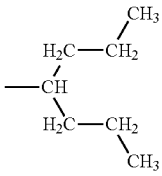 | — | — | — |

TABLE 13
| Exemplified compound | $R^{1201}$ | $R^{1202}$ | $R^{1203}$ | $R^{1204}$ | $R^{1205}$ | (1) A | (2) B | (2) C | (2) D |
|---|---|---|---|---|---|---|---|---|---|
| A1201 | H | $NO_2$ | H | H | (2) | — | — | 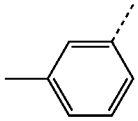 | ----$CH_2$—OH |
| A1202 | H | F | H | H | (2) | — | — | 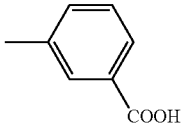 | H |
| A1203 | H | CN | H | H | (2) | — | — | 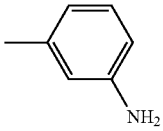 | H |
| A1204 | H | 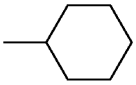 | H | H | (2) | — | — | 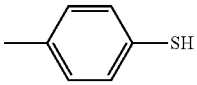 | H |
| A1205 | H | H | H | H | (2) | — | —$CH_2CH_2$--- | 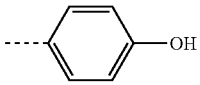 | H |
| A1206 | H | H | H | H | (1) | 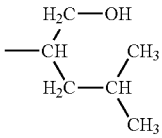 | — | — | — |
| A1207 | H | H | H | H | (1) | 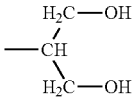 | — | — | — |
| A1208 | H | (1) | (1) | H | H | 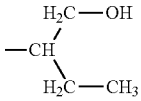 | — | — | — |
| A1209 | H | (1) | (1) | H | H | COOH | — | — | — |
TABLE 14
| Exemplified compound | $R^{1301}$ | $R^{1302}$ | $R^{1303}$ | $R^{1304}$ | $R^{1305}$ | $R^{1306}$ | $R^{1307}$ | (1) A | (2) B | (2) C | (2) D |
|---|---|---|---|---|---|---|---|---|---|---|---|
| A1301 | H | H | H | H | H | H | (2) | — | — | 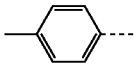 | ----$CH_2$—OH |
| A1302 | H | H | $NO_2$ | H | H | H | (2) | — | — | 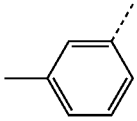 | ----$CH_2$—OH |

TABLE 14-continued
| Exemplified compound | $R^{1301}$ | $R^{1302}$ | $R^{1303}$ | $R^{1304}$ | $R^{1305}$ | $R^{1306}$ | $R^{1307}$ | (1) A | (2) B | (2) C | (2) D |
|---|---|---|---|---|---|---|---|---|---|---|---|
| A1303 | H | H | F | H | H | H | (2) | — | — | 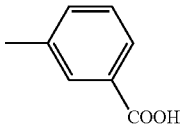 | H |
| A1304 | H | H | CN | H | H | H | (2) | — | — | 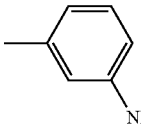 | H |
| A1305 | H | H | 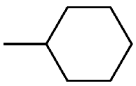 | H | H | H | (2) | — | — | 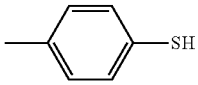 | H |
| A1306 | H | H | H | H | H | H | (2) | — | 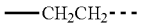 | 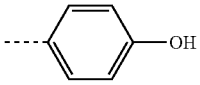 | H |
| A1307 | H | H | $—C_6H_{13}$ | H | H | H | (1) | $NH_2$ | — | — | — |
| A1308 | H | H | (2) | (2) | H | H | H | — | — | 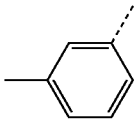 | ----$CH_2$—OH |
| A1309 | H | H | (1) | (1) | H | H | H | 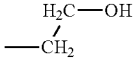 | — | — | — |
TABLE 15
| Exemplified compound | $R^{1401}$ | $R^{1402}$ | $R^{1403}$ | $R^{1404}$ | $R^{1405}$ | $R^{1406}$ | $R^{1407}$ | (1) A | (2) B | (2) C | (2) D |
|---|---|---|---|---|---|---|---|---|---|---|---|
| A1401 | H | H | H | H | H | H | (2) | — | — | 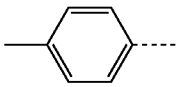 | ----$CH_2$—OH |
| A1402 | H | H | $NO_2$ | H | H | H | (2) | — | — | 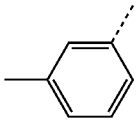 | ----$CH_2$—OH |
| A1403 | H | H | F | H | H | H | (2) | — | — | 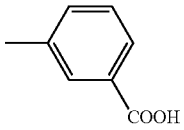 | H |
| A1404 | H | H | CN | H | H | H | (2) | — | — | 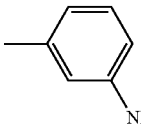 | H |

TABLE 15-continued
| Exemplified compound | $R^{1401}$ | $R^{1402}$ | $R^{1403}$ | $R^{1404}$ | $R^{1405}$ | $R^{1406}$ | $R^{1407}$ | (1) A | (2) B | (2) C | (2) D |
|---|---|---|---|---|---|---|---|---|---|---|---|
| A1405 | H | H | 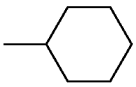 | H | H | H | (2) | — | — | 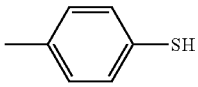 | H |
| A1406 | H | H | H | H | H | H | (2) | — | $—CH_2CH_2$--- | 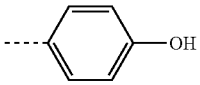 | H |
| A1407 | H | H | H | H | H | H | (1) | 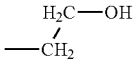 | — | — | — |
| A1408 | H | H | (2) | (2) | H | H | H | — | — | 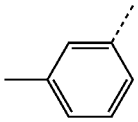 | ----$CH_2$—OH |
| A1409 | H | H | (1) | (1) | H | H | H | 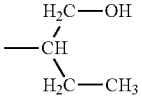 | — | — | — |
| A1410 | H | H | (1) | (1) | H | H | H | COOH | — | — | — |
TABLE 16
| Exemplified compound | $R^{1501}$ | $R^{1502}$ | $R^{1503}$ | (1) A | (2) B | (2) C | (2) D |
|---|---|---|---|---|---|---|---|
| A1501 | H | H | (2) | — | — | 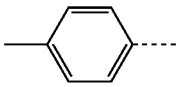 | ----$CH_2$—OH |
| A1502 | $NO_2$ | H | (2) | — | — | 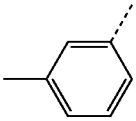 | ----$CH_2$—OH |
| A1503 | F | H | (2) | — | — | 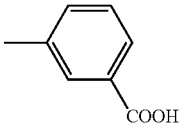 | H |
| A1504 | 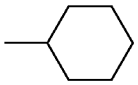 | H | (2) | — | — | 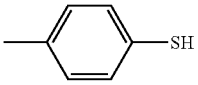 | H |
| A1505 | H | H | (1) | 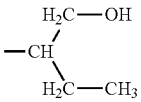 | — | — | — |

TABLE 16-continued
| Exemplified compound | $R^{1501}$ | $R^{1502}$ | $R^{1503}$ | (1) A | (2) B | (2) C | (2) D |
|---|---|---|---|---|---|---|---|
| A1506 | H | H | (1) | 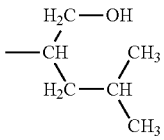 | — | — | — |
| A1507 | $—C_6H_{13}$ | H | (1) | $NH_2$ | — | — | — |
| A1508 | (2) | (2) | H | — | — | 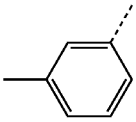 | ----$CH_2$—OH |
| A1509 | (1) | (1) | H | 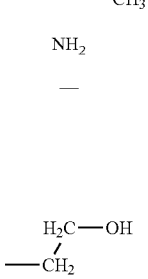 | — | — | — |
TABLE 17
| Exemplified compound | $R^{1601}$ | $R^{1602}$ | $R^{1603}$ | $R^{1604}$ | $R^{1605}$ | $Z^{1601}$ | (1) A | (2) B | (2) C | (2) D |
|---|---|---|---|---|---|---|---|---|---|---|
| A1601 | H | H | (2) | H | H | C | — | — | 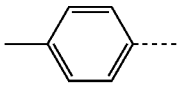 | ----$CH_2$—OH |
| A1602 | CN | H | (2) | H | H | C | — | — | 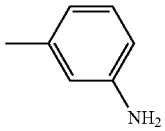 | H |
| A1603 | H | H | (2) | H | H | C | — | —$CH_2CH_2$--- | 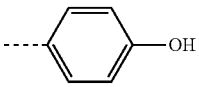 | H |
| A1604 | H | H | (1) | — | — | O | 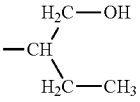 | — | — | — |
| A1605 | H | H | (1) | — | — | O | 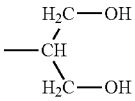 | — | — | — |
| A1606 | $—C_6H_{13}$ | H | (1) | H | — | N | $NH_2$ | — | — | — |
| A1607 | (2) | (2) | H | H | H | C | — | — | 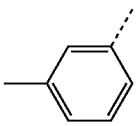 | ----$CH_2$—OH |
| A1608 | (1) | (1) | H | H | H | C | COOH | — | — | — |

TABLE 18

| Exemplified compound | $R^{1701}$ | $R^{1702}$ | $R^{1703}$ | $R^{1704}$ | (1) A | (2) B | (2) C | (2) D |
|---|---|---|---|---|---|---|---|---|
| A1701 | (2) | H | H | H | — | — | 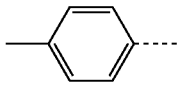 | ----$CH_2$—OH |
| A1702 | (2) | H | H | $NO_2$ | — | — | 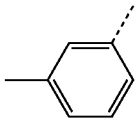 | ----$CH_2$—OH |
| A1703 | (2) | H | H | H | — | — | 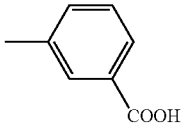 | H |
| A1704 | (2) | H | H | H | — | — | 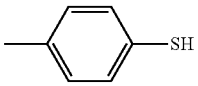 | H |
| A1705 | (2) | H | H | H | — | —$CH_2CH_2$--- | 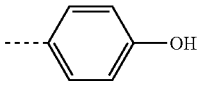 | H |
| A1706 | (1) | H | H | H | 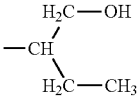 | — | — | — |
| A1707 | (1) | F | H | H | COOH | — | — | — |
| A1708 | (1) | CN | H | H | COOH | — | — | — |
| A1709 | (1) | 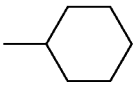 | H | H | COOH | — | — | — |
| A1710 | (1) | H | 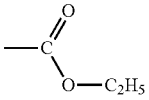 | H | COOH | — | — | — |
| A1711 | (2) | H | (2) | H | — | — | 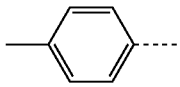 | ----$CH_2$—OH |
| A1712 | (2) | $NO_2$ | (2) | $NO_2$ | — | — | 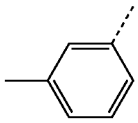 | ----$CH_2$—OH |
| A1713 | (2) | H | (2) | H | — | — | 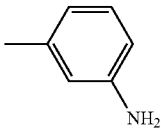 | H |

Derivatives having structures represented by (A2) to (A6), (A9), (A12) to (A15), and (A17) (derivatives of electron transporting materials) are commercially available from Tokyo Chemical Industry Co., Ltd., Sigma-Aldrich Japan K.K. and Johnson Matthey Japan G.K. Derivatives having a structure represented by (A1) can be synthesized through a reaction of naphthalene tetracarboxylic dianhydride commercially available from Tokyo Chemical Industry Co., Ltd. or Sigma-Aldrich Japan K.K. with a monoamine derivative. Derivatives having a structure represented by (A7) can be synthesized using a phenol derivative commercially available from Tokyo Chemical Industry Co., Ltd. or Sigma-Aldrich Japan K.K. as a raw material. Derivatives having a structure represented by (A8) can be synthesized through a reaction of perylene tetracarboxylic dianhydride commercially available from Tokyo Chemical Industry Co., Ltd. or Johnson Matthey Japan G.K. with a monoamine derivative. Derivatives having a structure represented by (A10) can be synthesized through oxidation of a compound commercially available from Tokyo Chemical Industry Co., Ltd. or Sigma-Aldrich Japan K.K. with an appropriate oxidizing agent (such as potassium permanganate) in an organic solvent (such as chloroform). Derivatives having a structure represented by (A11) can be synthesized through a reaction of naphthalene tetracarboxylic dianhydride commercially available from Tokyo Chemical Industry Co., Ltd. or Sigma-Aldrich Japan K.K. with a monoamine derivative and hydrazine. Derivatives having a structure represented by the formula (A16) can be synthesized by a known method usually used in synthesis of carboxylic acid imide.

The compounds represented by the formulae (A1) to (A17) each have a reactive functional group (a hydroxy group, a thiol group, an amino group, a carboxyl group and a methoxy group) polymerizable with a crosslinking agent. These reactive functional groups can be introduced into the derivatives having structures represented by (A1) to (A17) by the following two methods. One of the methods directly introduces a reactive functional group into the derivatives having the structures represented by (A1) to (A17). The other method introduces a structure having a reactive functional group or a functional group which can be converted into a precursor of a reactive functional group. Examples of the other method include a method of introducing a functional group-containing aryl group into a halide of a derivative having a structure represented by one of (A1) to (A17) through a cross-coupling reaction using a palladium catalyst and a base. Examples thereof also include a method of introducing a functional group-containing alkyl group through a cross-coupling reaction using a $FeCl_3$ catalyst and a base. Other examples thereof include a method of performing lithiation and then allowing an epoxy compound or carbon dioxide to act on the lithioated product to introduce a hydroxyalkyl group or a carboxyl group.

(Crosslinking Agent)

Next, the crosslinking agent will be described. Any compound enabling polymerization or crosslinking of an electron transporting material having a reactive functional group and a resin having a reactive functional group described later can be used as a crosslinking agent without limitation. Specifically, compounds described in "Kakyozai Handobukku (Handbook of Crosslinking Agents)," edited by Shinzo Yamashita and Tosuke Kaneko, published by Taiseisha Ltd. (1981) can be used, for example.

An isocyanate compound can be used as a crosslinking agent in the present invention. The isocyanate compound can have a molecular weight within the range of 200 to 1300. The isocyanate compound has preferably two or more, more preferably 3 to 6 isocyanate or block isocyanate groups. Examples of the isocyanate compound include triisocyanatebenzene, triisocyanatemethylbenzene, triphenylmethane triisocyanate and lysine triisocyanate; isocyanurate modified products of diisocyanate such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate and norbornane diisocyanate; biuret modified products; allophanate modified products; and adduct modified products with trimethylolpropane or pentaerythritol. Among these isocyanate compounds, isocyanurate modified products and adduct modified products are more preferred.

The block isocyanate group has a structure represented by —$NHCOX^1$ where $X^1$ is a protecting group. $X^1$ can be any protecting group which can be introduced into an isocyanate group, and can be one of groups represented by the following formulae (H1) to (H7):

(H1)

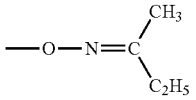

(H2)

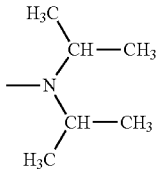

(H3)

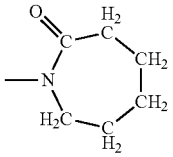

(H4)

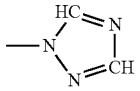

(H5)

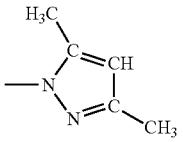

(H6)

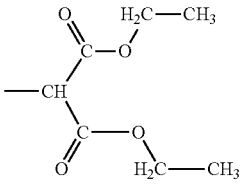

(H7)

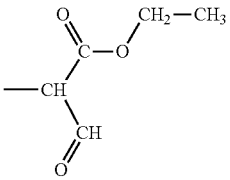

Specific examples of the isocyanate compound are shown below:

(B1)

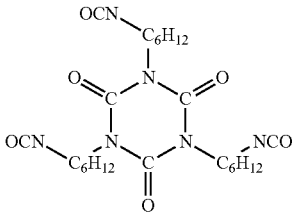

(B2)

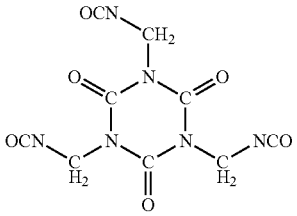

(B3)

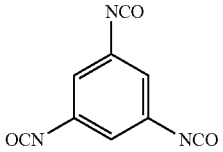

(B4)

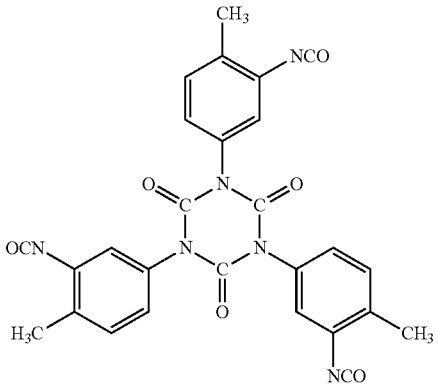

(B5)

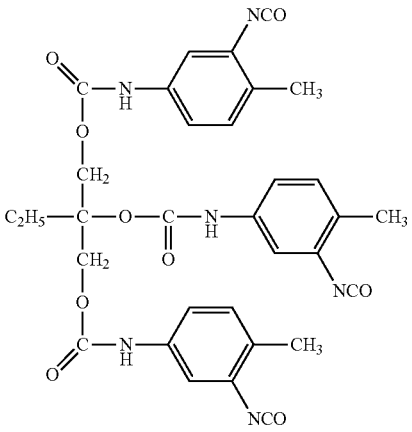

-continued (B6)

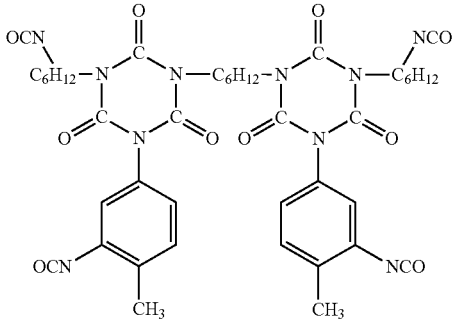

(B7)

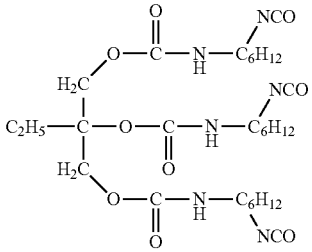

(B8)

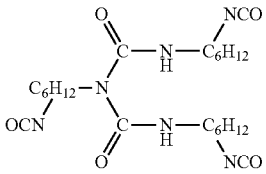

(B9)

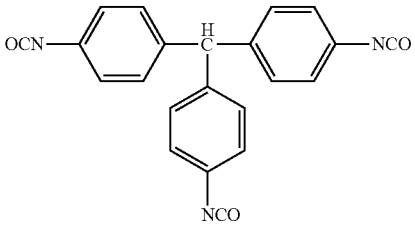

(B10)

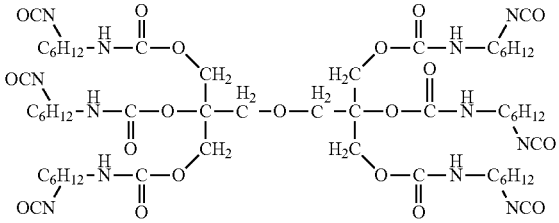

(Resin)

The resin having a reactive functional group (polymerizable functional group) will now be described. The resin having a reactive functional group can be a resin having a structure unit represented by the following formula (D):

(D)

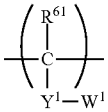

where $R^{61}$ represents a hydrogen atom or an alkyl group; $Y^1$ represents a single bond, an alkylene group or a phenylene group; and $W^1$ represents a hydroxy group, a thiol group, an amino group, a carboxyl group or a methoxy group.

Examples of the resin having a structure unit represented by the formula (D) include acetal resins, polyolefin resins, polyester resins, polyether resins and polyamide resins. These resins may have the structure unit represented by the formula (D) and further characteristic structures represented by (E-1) to (E-5) below. The structure (E-1) corresponds to a structure unit of an acetal resin, the structure (E-2) corresponds to a structure unit of a polyolefin resin, the structure (E-3) corresponds to a structure unit of a polyester resin, the structure (E-4) corresponds to a structure unit of a polyether resin, and the structure (E-5) corresponds to a structure unit of a polyamide resin.

(E-1)

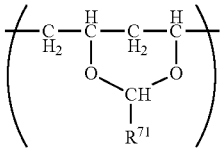

(E-2)

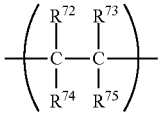

(E-3)

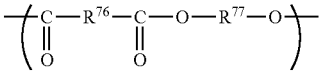

(E-4)

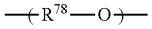

(E-5)

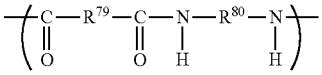

where $R^{71}$ to $R^{75}$ each independently represent a substituted or unsubstituted alkyl group, or a substituted or unsubstituted aryl group; and $R^{76}$ to $R^{80}$ each independently represent a substituted or unsubstituted alkylene group, or a substituted or unsubstituted arylene group. For example, if $R^{71}$ is $C_3H_7$, the structure (E-1) represents butyral.

The resin having a structure unit represented by the formula (D) can also be generally commercially available. Examples of such commercially available resins include polyether polyol resins such as AQD-457 and AQD-473 manufactured by Nippon Polyurethane Industry Co., Ltd., and SANNIX GP-400 and GP-700 manufactured by Sanyo Chemical Industries, Ltd.; polyester polyol resins such as Phthalkyd W2343 manufactured by Hitachi Chemical Co., Ltd., WATERSOL S-118 and CD-520, and BECKOLITE M-6402-50 and M-6201-40IM manufactured by DIC Corporation, HARIDIP WH-1188 manufactured by Harima Chemicals, Incorporated, and ES3604 and ES6538 manufactured by Japan U-pica Co., Ltd.; polyacrylic polyol resins such as BURNOCK WE-300 and WE-304 manufactured by DIC Corporation; poly(vinyl alcohol) resins such as Kuraray POVAL PVA-203 manufactured by Kuraray Co., Ltd.; poly (vinyl acetal) resins such as KS-5, KS-5Z, BX-1 and BM-1 manufactured by Sekisui Chemical Co., Ltd.; polyamide resins such as TORESIN FS-350 manufactured by Nagase ChemteX Corporation; carboxyl group-containing resins such as Aqualic manufactured by NIPPON SHOKUBAI CO., LTD., and FINELEX SG2000 manufactured by Namariichi Co., Ltd.; polyamine resins such as LUCKAMIDE manufactured by DIC Corporation; and polythiol resins such as QE-340M manufactured by Toray Industries, Inc. Among these resins, poly(vinyl acetal) resins and polyester polyol resins are more preferred. The resin having a structure unit represented by the formula (D) can have a weight average molecular weight (Mw) within the range of 5000 to 300000.

(Solvent)

Examples of the solvent used in the coating solution for an intermediate layer include alcohols such as methanol, ethanol, isopropanol, 1-methoxy-2-propanol and butanol; ketones such as acetone, methyl ethyl ketone and cyclohexanone; amides such as dimethylacetamide; ethers such as tetrahydrofuran, dioxane, ethylene glycol monomethyl ether and propylene glycol monomethyl ether; esters such as methyl acetate and ethyl acetate; and aromatic hydrocarbons such as toluene and xylene. These solvents may be used singly or in combinations of two or more.

A catalyst may be used when necessary in formation of the intermediate layer. Examples of the catalyst include zinc(II) hexanoate and zinc(II) octylate.

In the electrophotographic photosensitive member according to the present invention, the volume (% by volume) of the complex particle in the total volume of the undercoat layer can be 0.2 times or more and 2 times or less the volume (% by volume) of the electron transporting material in the total volume of the composition of the intermediate layer. A volume of the complex particle within this range reduces charging streaks. The present inventors infer that the degrees of polarization of the undercoat layer and the intermediate layer are increased to increase dielectric relaxation of the electrophotographic photosensitive member; as a result, the difference in potential in the downstream region of the charging region is increased to reduce charging streaks. The volume is determined at a temperature of 23° C. under 1 atmospheric pressure.

<Photosensitive Layer>

A photosensitive layer is disposed on the undercoat layer or the intermediate layer. The photosensitive layer may be a photosensitive monolayer, or may be a photosensitive layer including a laminate. A photosensitive layer including a laminate including a charge generating layer and a charge transport layer is preferred.

[Charge Generating Layer]

In a photosensitive layer including a laminate, the charge generating layer can be formed as follows: a charge generating material and a binder resin are dispersed in a solvent to prepare a coating solution for a charge generating layer, and the coating solution is applied, and is dried. Examples of the dispersion method include methods using homogenizers, ultrasonic waves, ball mills, sand mills, attritors and roll mills.

(Charge Generating Material)

Examples of the charge generating material include azo pigments, phthalocyanine pigments, indigo pigments such as indigo and thioindigo, perylene pigments, polycyclic quinone pigments, squarylium dyes, pyrylium salts, thiapyrylium salts, triphenylmethane dyes, quinacridone pigments, azulenium salt pigments, cyanine dyes, xanthene dyes, quinoneimine dyes, and styryl dyes. Among these charge generating materials, metal phthalocyanine such as oxytitanium phthalocyanine, hydroxygallium phthalocyanine and chlorogallium phthalocyanine can be used. These charge generating materials may be used singly or in combinations of two or more.

(Binder Resin)

Examples of the binder resin used in the charge generating layer include polycarbonate, polyester, polyarylate, butyral resins, polystyrene, poly(vinyl acetal), diallyl phthalate resins, acrylic resins, methacrylic resins, vinyl acetate resins, phenol resins, silicone resins, polysulfone, styrene-butadiene copolymers, alkyd resins, epoxy resins, urea resins and vinyl chloride-vinyl acetate copolymers. These binder resins can be used singly, or two or more thereof can be used in the form of a mixture or a copolymer.

The mass ratio of the charge generating material to the binder resin (charge generating material:binder resin) is within the range of preferably 10:1 to 1:10, more preferably 5:1 to 1:1, particularly preferably 3:1 to 1:1.

(Solvent)

Examples of the solvent used in the coating solution for a charge generating layer include alcohols such as methanol, ethanol, isopropanol and 1-methoxy-2-propanol; sulfoxides such as dimethyl sulfoxide; ketones such as acetone, methyl ethyl ketone and cyclohexanone; ethers such as dimethoxymethane, dimethoxyethane, tetrahydrofuran, dioxane, ethylene glycol monomethyl ether and propylene glycol monomethyl ether; esters such as methyl acetate and ethyl acetate; hydrocarbons substituted with a halogen atom such as chlorobenzene, chloroform and carbon tetrachloride; and aromatic compounds such as toluene and xylene. These solvents may be used singly or in combinations of two or more.

The charge generating layer has a thickness of preferably 0.1 μm or more and 5 μm or less, more preferably 0.1 μm or more and 2 μm or less. The charge generating layer may contain a variety of sensitizers, antioxidants, ultraviolet absorbing agents and plasticizers when necessary. Moreover, the charge generating layer may contain an electron transporting material (electron receiving substances such as acceptors) so as to prevent stagnation of a flow of charges in the charge generating layer.

[Charge Transport Layer]

In a photosensitive layer including a laminate, the charge transport layer can be formed as follows: a charge transport material and a binder resin are dissolved in a solvent to prepare a coating solution for a charge transport layer, and the coating solution is applied to form a coating, and the coating is dried.

The degree of dielectric polarization of the charge transport layer can be reduced to prevent dark decay in the downstream region of the charging region and the following regions, because a fluctuation in the amount of dark decay during repeated use is reduced. Specifically, the binder resin can have a permittivity of 3 or less. The charge transport material can have a charge mobility of $1\times10^{-6}$ cm/V·sec or less.

(Charge Transport Material)

Specific examples of the charge transport material that can be used include hydrazone compounds, styryl compounds, benzidine compounds, triarylamine compounds and triphenylamine compound. These charge transport materials may be used singly or in combinations of two or more.

(Binder Resin)

Specific examples of the binder resin include acrylic resins, styrene resins, polyester, polycarbonate, polyarylate, polysulfone, poly(phenylene oxide), epoxy resins, polyurethane and alkyd resins. Particularly, polyester, polycarbonate and polyarylate can be used. These resins can be used singly, or two or more thereof can be used in the form of a mixture or a copolymer. The mass ratio of the charge transport material to the binder resin (charge transport material:binder resin) can be within the range of 2:1 to 1:2.

(Solvent)

Examples of the solvent used in the coating solution for a charge transport layer include ketones such as acetone and methyl ethyl ketone; esters such as methyl acetate and ethyl acetate; ethers such as dimethoxymethane and dimethoxyethane; aromatic hydrocarbons such as toluene and xylene; and hydrocarbons substituted with a halogen atom such as chlorobenzene, chloroform and carbon tetrachloride. These solvents may be used singly or in combinations of two or more.

The charge transport layer has a thickness of preferably 3 μm or more and 40 μm or less, more preferably 5 μm or more and 30 μm or less. The charge transport layer can contain an antioxidant, an ultraviolet absorbing agent and a plasticizer when necessary.

<Protective Layer>

A protective layer may be disposed on the photosensitive layer to protect the photosensitive layer. The protective layer can be formed as follows: a coating solution for a protective layer containing a resin (binder resin) is applied to form a coating, and the coating is dried and/or cured.

(Binder Resin)

Examples of the binder resin used in the protective layer include phenol resins, acrylic resins, polystyrene, polyester, polytetrafluoroethylene, polycarbonate, polyarylate, polysulfone, poly(phenylene oxide), epoxy resins, polyurethane, alkyd resins and siloxane resins. These resins can be used singly, or two or more thereof can be used in the form of a mixture or a copolymer.

(Solvent)

Examples of the solvent used in the coating solution for a protective layer include alcohols such as methanol, ethanol, n-propanol, isopropanol and 1-methoxy-2-propanol; sulfoxides such as dimethyl sulfoxide; ketones such as acetone, methyl ethyl ketone and cyclohexanone; ethers such as dimethoxymethane, dimethoxyethane, tetrahydrofuran, dioxane, ethylene glycol monomethyl ether and propylene glycol monomethyl ether; esters such as methyl acetate and ethyl acetate; hydrocarbons substituted with a halogen atom such as chlorobenzene, chloroform and carbon tetrachloride; and aromatic compounds such as toluene and xylene.

The protective layer has a thickness of preferably 0.5 μm or more and 10 μm or less, more preferably 1 μm or more and 8 μm or less.

The coating solutions for these layers described above can be applied by application methods such as immersion application (immersion coating), spray coating, spinner coating, roller coating, Meyer bar coating and blade coating, for example.

Figure 1:
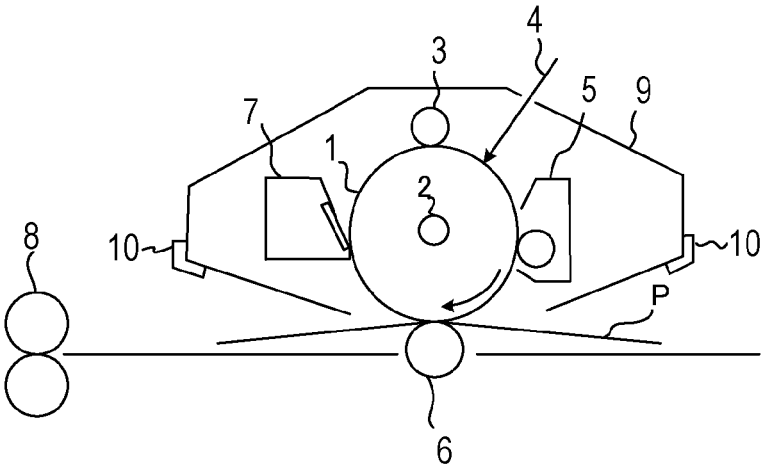
FIG. 1 is a diagram illustrating an example of a schematic configuration of an electrophotographic apparatus including a process cartridge including an electrophotographic photosensitive member according to the present invention.

FIG. 1 illustrates an example of a schematic configuration of an electrophotographic apparatus including a process cartridge including an electrophotographic photosensitive member. In FIG. 1, a cylindrical electrophotographic photosensitive member 1 is driven to rotate about an axis 2 in the arrow direction at a predetermined circumferential speed. The circumferential surface of the electrophotographic photosensitive member 1 is uniformly charged by a charging unit (such as a charging roller) 3 to a predetermined positive or negative potential while the electrophotographic photosensitive member 1 is being driven to rotate. The circumferential surface of the electrophotographic photosensitive member 1 then receives exposure light (image exposure light) 4 emitted from an exposure unit (image exposure unit, not illustrated) using slit exposure or laser beam scanning exposure. Through exposure with light, an electrostatic latent image corresponding to the target image is sequentially formed on the circumferential surface of the electrophotographic photosensitive member 1. Only a DC voltage may be applied to the charging unit 3, or a DC voltage superimposed with an AC voltage may be applied to the charging unit 3.

The electrostatic latent image formed on the circumferential surface of the electrophotographic photosensitive member 1 is developed with a toner from a developing unit 5 to form a toner image. Then, the toner image formed on the circumferential surface of the electrophotographic photosensitive member 1 is transferred onto a transfer medium (such as paper) P by the transfer bias from a transfer unit (such as a transfer roller) 6. The transfer medium P is fed from a transfer medium feeding unit (not illustrated) into a region (contact region) between the electrophotographic photosensitive member 1 and the transfer unit 6 synchronizing with the rotation of the electrophotographic photosensitive member 1.

The transfer medium P carrying a transferred toner image is separated from the circumferential surface of the electrophotographic photosensitive member 1, and thereafter is introduced into a fixing unit 8 to fix the image. An image forming product (print or copy) is printed out from the apparatus.

The circumferential surface of the electrophotographic photosensitive member 1 after toner image transfer is cleaned by a cleaning unit (such as a cleaning blade) 7 to remove the transfer residual toner. The circumferential surface of the electrophotographic photosensitive member 1 is discharged with pre-exposure light (not illustrated) from a pre-exposure unit (not illustrated), and thereafter is repeatedly used for image formation. If the charging unit is a contact charging unit, pre-exposure is not always necessary.

A plurality of components selected from the components such as the electrophotographic photosensitive member 1 according to the present invention, the charging unit 3, the developing unit 5, and the cleaning unit 7 may be accommodated in a container, and may be integrally formed into a process cartridge. The process cartridge may be configured to be detachably mountable on the main body of the electrophotographic apparatus. In FIG. 1, the electrophotographic photosensitive member 1, the charging unit 3, the developing unit 5 and the cleaning unit 7 are integrally supported in the form of a cartridge, and are formed into a process cartridge 9 detachably mountable on the main body of the electrophotographic apparatus with a guiding unit 10 such as a rail in the main body of the electrophotographic apparatus.

Moreover, the electrophotographic photosensitive member according to the present invention, the charging unit, the exposure unit, the developing unit, and the transfer unit can be combined to form an electrophotographic apparatus.

A charging unit suitably used in the process cartridge and the electrophotographic apparatus according to the present invention is a roller-shaped charging member (charging roller). Examples of the configuration of the charging roller include a configuration including a conductive substrate and one or more coating layers formed on the conductive substrate. At least one layer of the coating layers has conductivity. More specifically, the charging roller includes a conductive substrate, a conductive elastic layer formed on the conductive substrate, and a surface layer formed on the conductive elastic layer.

The charging roller can have a surface ten-point height of irregularities (Rzjis) of 5.0 μm or less. In the present invention, the surface ten-point height of irregularities (Rzjis) of the charging roller is measured with a surface roughness analyzer (trade name: SE-3400) manufactured by Kosaka Laboratory Ltd.

In the electrophotographic photosensitive member according to the present invention, as the time in the upstream region of the charging region is shorter, namely, the rotational speed (cycle speed) of the electrophotographic apparatus having the electrophotographic photosensitive member mounted thereon is higher, the effect of preventing charging streaks is more remarkably demonstrated. Specifically, the effect of preventing charging streaks is demonstrated at a rotational speed of the electrophotographic apparatus of 0.5 s/turns. The effect is more effective at 0.3 s/turns, and is particularly remarkable at 0.2 s/turns.

EXAMPLES

The present invention will now be described in more detail by way of specific Examples. It should be noted that the present invention is not be limited to these Examples. "Parts" in the following description indicate "parts by mass."

[Production of Zinc-Doped Tin Oxide-Coated Complex Particle]

In the Examples below, zinc-doped tin oxide-coated titanium oxide particles were each produced as follows. The type of the core material for a complex particle, the type and the amount of a doping agent, and the amount of sodium stannate were varied according to these Examples.

200 g of a titanium oxide particle (average primary particle diameter: 200 nm) as a core particle was dispersed in water. Subsequently, 208 g of sodium stannate ($Na_2SnO_3$) containing 41% by mass of tin was added, and was dissolved to prepare a mixed slurry. While the mixed slurry was being circulated, a diluted aqueous solution of 20% by mass of sulfuric acid was added to neutralize tin. The diluted aqueous solution of sulfuric acid was added until the pH of the mixed slurry reached 2.5. After neutralization, zinc(II) chloride (4 mol % relative to the amount of tin) was added to the mixed slurry, and the mixed slurry was stirred. A precursor for a target complex particle was thereby prepared. The precursor was washed with hot water, and thereafter was dehydrated through filtration to obtain a solid product. The solid product was reduced through firing under a 2% by volume $H_2/N_2$ atmosphere at 500° C. for 1 hour to prepare a target zinc-doped tin oxide-coated titanium oxide particle. The amount of zinc doped was 1.51% by mass of the amount of tin oxide.

The amount (% by mass) of zinc doped relative to the amount of tin oxide can be measured with an ICP optical emission spectrometer, for example. As a measurement target, the undercoat layer scraped after separation of the photosensitive layer of the electrophotographic photosensitive member and when necessary the intermediate layer can also be used. Alternatively, a powder having the same material as the material of the undercoat layer can be used. Such a sample is dissolved with an acid such as sulfuric acid to prepare a solution, and the solution is measured.

Example 1

(Support)

An aluminum cylinder (conductive support) having a diameter of 24 mm and a length of 261 mm was used as a support.

(Formation of Undercoat Layer)

Next, 219 parts of a zinc-doped tin oxide-coated titanium oxide particle (powder resistivity: $1.0\times10^4$ Ω·cm, tin oxide coating rate: 30% by mass, average primary particle diameter: 200 nm), 183 parts of a phenol resin (monomer/oligomer of a phenol resin) (trade name: Plyophen J-325, manufactured by DIC Corporation, resin solid content: 60%) as a binder resin, and 106 parts of 1-methoxy-2-propanol as a solvent were placed in a sand mill containing 420 parts of glass beads having a diameter of 1.0 mm. These materials were dispersed at a number of rotations of 2000 rpm, a dispersion time of 4 hours, and a setting temperature of cooling water of 18° C. to prepare a dispersion liquid. The glass beads were removed from the dispersion liquid through a mesh. Subsequently, 23.7 parts of silicone resin particles (trade name: Tospearl 120, manufactured by Momentive Performance Materials Inc., average particle diameter: 2 μm) as a surface roughening material, 0.024 parts of silicone oil (trade name: SH28PA, manufactured by Dow Corning Toray Co., Ltd.) as a leveling agent, 6 parts of methanol, and 6 parts of 1-methoxy-2-propanol were added to the dispersion liquid, and were stirred to prepare a coating solution for an undercoat layer. The coating solution for an undercoat layer was applied onto the support through immersion application to form a coating, and the coating was dried at 145° C. for 30 minutes to form an undercoat layer having a thickness of 30

(Formation of Charge Generating Layer)

Then, hydroxygallium phthalocyanine crystals (charge generating material) having peaks at 7.4° and 28.1° of the Bragg angle of 2±0.2° in CuKα characteristic X-ray diffraction were prepared. 4 parts of the hydroxygallium phthalocyanine crystals and 0.04 parts of a compound represented by the following formula (A) were added to a solution of 2 parts of a polyvinyl butyral resin (trade name: S-LEC BX-1, manufactured by Sekisui Chemical Co., Ltd.) dissolved in 100 parts of cyclohexanone. The resulting solution was dispersed with a sand mill containing glass beads having a diameter of 1 mm under an atmosphere of 23±3° C. for 1 hour. After dispersion, 100 parts of ethyl acetate was added to prepare a coating solution for a charge generating layer. The coating solution for a charge generating layer was applied onto the undercoat layer through immersion application to form a coating, and the coating was dried at 90° C. for 10 minutes to form a charge generating layer having a thickness of 0.20 μm.

(Formation of Charge Transport Layer)

Then, 50 parts of an amine compound represented by the following formula (B) (charge transport material), 50 parts of an amine compound represented by the following formula (C) (charge transport material), and 100 parts of a polycarbonate resin (trade name: Iupilon 2400, manufactured by MITSUBISHI GAS CHEMICAL COMPANY, INC.) were dissolved in a mixed solvent of 650 parts of chlorobenzene and 150 parts of dimethoxymethane to prepare a coating solution for a charge transport layer. The coating solution for a charge transport layer was preserved for 1 day, and thereafter was applied onto the charge generating layer through immersion application to form a coating. The coating was dried at 110° C. for 30 minutes to prepare a charge transport layer having a thickness of 21 μm. An electrophotographic photosensitive member was thereby produced.

(B)

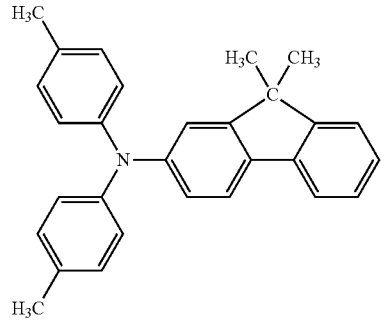

(C)

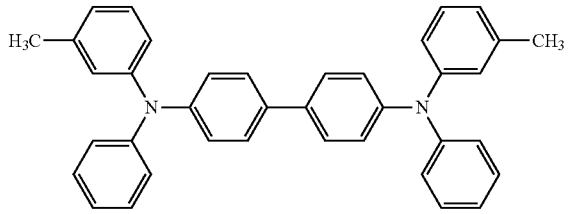

(Evaluation of Image in Repeated Use)

Images were evaluated in repeated use of the electrophotographic photosensitive member produced. An apparatus (A)

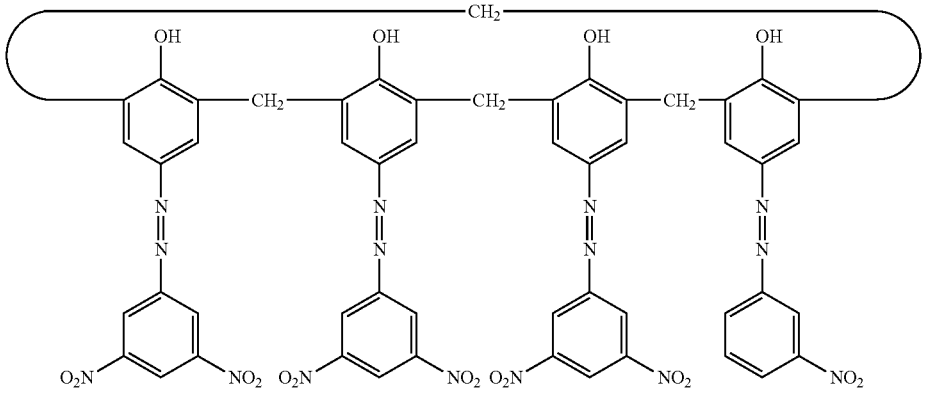

used in evaluation was a color laser beam printer manufactured by Hewlett-Packard Japan, Ltd. (trade name: CP4525, modified such that the process speed was variable). The electrophotographic photosensitive member was mounted on the drum cartridge of the apparatus used in evaluation, and the apparatus used in evaluation was placed under an environment at a low temperature and a low humidity (temperature: 15° C., humidity: 10% RH), and evaluation was performed.

The surface potential of the electrophotographic photosensitive member was measured as follows: a cartridge for developing was dismounted from the apparatus used in evaluation, and a potential probe (trade name: model 6000B-8, manufactured by Trek, Inc.) was fixed in the resulting space; the surface potential of the electrophotographic photosensitive member was measured with a surface electrometer (model 344: manufactured by Trek, Inc.). The probe for measuring a potential of the potential measurement apparatus was disposed at the development position of the cartridge for developing. The probe for measuring a potential was positioned at the center in the axis direction of the electrophotographic photosensitive member, and was spaced 3 mm from the surface of the electrophotographic photosensitive member. As the charging conditions, the bias to be applied was adjusted such that the surface potential of the electrophotographic photosensitive member (dark potential) was 600 V. The exposure conditions were adjusted such that the light intensity was 0.4 $\mu J/cm^2$. In the Examples below, the electrophotographic photosensitive members were each evaluated on the charging conditions and the exposure conditions initially set.

The electrophotographic photosensitive member was first preserved under an environment at a low temperature and a low humidity (temperature: 15° C., humidity: 10% RH) for 48 hours. Then, the cartridge for developing including the electrophotographic photosensitive member was mounted on the apparatus used in evaluation, and the electrophotographic photosensitive member was repeatedly used in an operation to feed 15000 sheets of paper. The coverage rate was 4% in the operation to feed 15000 sheets of paper. The operation to feed 15000 sheets of paper was performed such that an operation to output two sheets and pause was repeated. The process speed of the electrophotographic photosensitive member in repeated use was 0.3 s/turns.

After 15000 sheets of paper were fed, a monochromatic halftone image was output with a cartridge disposed in the black station. The monochromatic halftone image was output at three different process speeds of the electrophotographic photosensitive member, i.e., 0.5 s/turns, 0.3 s/turns and 0.2 s/turns. The output images were evaluated for charging streaks. The results are shown in Table 19. The images were evaluated according to the following criteria based on charging streaks (horizontal streaks):

<Evaluation of Charging Streaks>

A: no charging streaks are found.

B: charging streaks are slightly found at the ends of the image.

D: charging streaks are found.

E: charging streaks are clearly found.

Example 2

The polycarbonate resin used in the charge transport layer in Example 1 was replaced with a polyester resin having a structure unit represented by the following formula (16-1) and a structure unit represented by the following formula (16-2) in a ratio of 5/5, and having a weight average molecular weight (Mw) of 100000. Except for that, an electrophotographic photosensitive member was produced in the same manner as in Example 1, and images were evaluated in the same manner as in Example 1. The results are shown in Table 19.

(16-1)

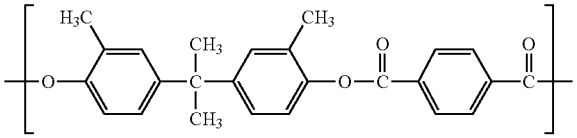

(16-2)

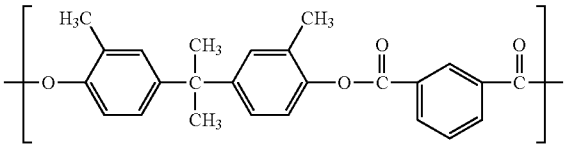

Example 3

An electrophotographic photosensitive member was produced in the same manner as in Example 1 except that a protective layer was formed on the charge transport layer in Example 1 as follows, and images were evaluated in the same manner as in Example 1. The results are shown in Table 19.

(Formation of Protective Layer)

36 parts of a compound (D) represented by the following formula, 4 parts of polytetrafluoroethylene resin particles (trade name: LUBRON L-2, manufactured by DAIKIN INDUSTRIES, LTD.), and 60 parts of n-propanol were mixed. The mixture was thereafter placed in an ultra-high pressure dispersing machine, and was dispersed to prepare a coating solution for a protective layer.

The coating solution for a protective layer was applied onto the charge transport layer through immersion application to form a coating, and the coating was dried at 50° C. for 5 minutes. After drying, the coating was irradiated with electron beams for 1.6 seconds under a nitrogen atmosphere at an accelerating voltage of 70 kV and an absorption dose of 8000 Gy while the support was being rotated. Subsequently, the coating was heat treated for 3 minutes under a nitrogen atmosphere such that the temperature of the coating was 130° C. The oxygen concentration during the steps from irradiation with electron beams to the heat treatment for 3 minutes was 20 ppm. Then, the coating was heat treated in the air for 30 minutes such that the temperature of the coating was 100° C. A protective layer (second charge transport layer) having a thickness of 5 μm was thereby formed.

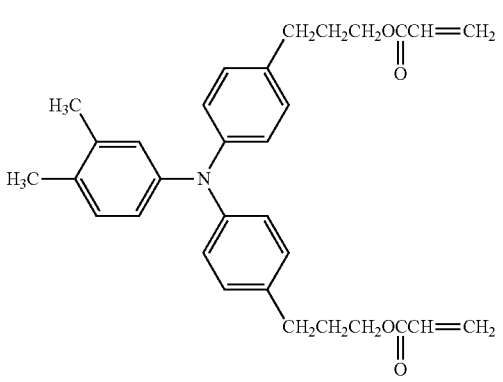

(D)

Example 4

An electrophotographic photosensitive member was produced in the same manner as in Example 1 except that an intermediate layer was formed on the undercoat layer in Example 1 as follows, and images were evaluated in the same manner as in Example 1. The results are shown in Table 19.

(Formation of Intermediate Layer)

4.5 parts of N-methoxymethylated nylon (trade name: TORESIN EF-30T, manufactured by Nagase ChemteX Corporation) and 1.5 parts of a copolymerization nylon resin (trade name: AMILAN CM8000, manufactured by Toray Industries, Inc.) were dissolved in a mixed solvent of 65 parts of methanol/30 parts of n-butanol to prepare a coating solution for an intermediate layer. The coating solution for an intermediate layer was applied onto the undercoat layer through immersion application to form a coating, and the coating was dried at 70° C. for 6 minutes to form an intermediate layer having a thickness of 0.65 μm.

Example 5

An electrophotographic photosensitive member was produced in the same manner as in Example 1 except that an intermediate layer was formed on the undercoat layer in Example 1 as follows, and images were evaluated in the same manner as in Example 1. The results are shown in Table 19.

(Formation of Intermediate Layer)

8 parts of Exemplified compound A101 as an electron transporting material having a reactive functional group, 10 parts of an isocyanate compound (B1), as a crosslinking agent, blocked with a group represented by the formula (H1), 0.1 parts of zinc(II) octylate, and 2 parts of a polyvinyl butyral resin (KS-5, manufactured by SEKISUI CHEMICAL CO., LTD.) were dissolved in a mixed solvent of 100 parts of dimethylacetamide and 100 parts of methyl ethyl ketone to prepare a coating solution for an intermediate layer. The coating solution for an intermediate layer was applied onto the undercoat layer through immersion application to form a coating, and the coating was cured (polymerized) through heating at 160° C. for 30 minutes to form an intermediate layer having a thickness of 0.5 μm. The intermediate layer is an intermediate layer containing a polymerized product of a composition containing the electron transporting material having a reactive functional group.

The specific gravity of the zinc-doped tin oxide-coated titanium oxide used in Example 5 is 5.1 g/cm$^3$, and the specific gravity of other materials used in the undercoat layer is 1.0 g/cm$^3$. Accordingly, the volume of the complex particle in the total volume of the undercoat layer is 24.3% by volume. The specific gravity of all the materials used in the intermediate layer in Example 5 is 1.0 g/cm$^3$. Accordingly, the volume of the electron transporting material in the total volume of the composition of the intermediate layer is 40% by volume. Consequently, the volume of the complex particle in the total volume of the undercoat layer is 0.61 times the volume of the electron transporting material in the total volume of the composition of the intermediate layer.

Example 6

The core particle of the zinc-doped tin oxide-coated titanium oxide particle used in the undercoat layer in Example 5, i.e., a titanium oxide particle was replaced with a barium sulfate particle. Except for that, an undercoat layer was formed in the same manner as in Example 5 to produce an electrophotographic photosensitive member. Images were evaluated using this electrophotographic photosensitive member in the same manner as in Example 5. The results are shown in Table 19. The specific gravity of the zinc-doped tin oxide-coated barium sulfate particle used in Example 6 was 5.3 g/cm$^3$.

Example 7

The core particle of the zinc-doped tin oxide-coated titanium oxide particle used in the undercoat layer in Example 5, i.e., a titanium oxide particle was replaced with a zinc oxide particle. Except for that, an undercoat layer was formed in the same manner as in Example 5 to produce an electrophotographic photosensitive member. Images were evaluated using this electrophotographic photosensitive member in the same manner as in Example 5. The results are shown in Table 19. The specific gravity of the zinc-doped tin oxide-coated zinc oxide particle used in Example 7 was 6.1 g/cm$^3$.

Example 8

The core particle of the zinc-doped tin oxide-coated titanium oxide particle used in the undercoat layer in Example 5, i.e., a titanium oxide particle was replaced with an aluminum oxide particle. Except for that, an undercoat layer was formed in the same manner as in Example 5 to produce an electrophotographic photosensitive member. Images were evaluated using this electrophotographic photosensitive member in the same manner as in Example 5. The results are shown in Table 19. The specific gravity of the zinc-doped tin oxide-coated aluminum oxide particle used in Example 8 was 5.0 g/cm$^3$.

Example 9

An undercoat layer was formed in the same manner as in Example 5 except that the amount of zinc doped in the zinc-doped tin oxide-coated titanium oxide particle in the undercoat layer in Example 5 was changed to 0.05% by mass. An electrophotographic photosensitive member was thereby produced. Images were evaluated using this electrophotographic photosensitive member in the same manner as in Example 5. The results are shown in Table 19. The powder resistance of the zinc-doped tin oxide-coated titanium oxide particle was $2.0\times10^3$ Ω·cm.

Example 10

An undercoat layer was formed in the same manner as in Example 5 except that the amount of zinc doped in the zinc-doped tin oxide-coated titanium oxide particle in the undercoat layer in Example 5 was changed to 3.0% by mass. An electrophotographic photosensitive member was thereby produced. Images were evaluated using this electrophotographic photosensitive member in the same manner as in Example 5. The results are shown in Table 19. The powder resistance of the zinc-doped tin oxide-coated titanium oxide particle was $1.0\times10^5$ Ω·cm.

Example 11

An undercoat layer was formed in the same manner as in Example 5 except that the binder resin and the solvent used in the undercoat layer in Example 5 were varied as follows, and the drying was performed at 170° C. for 30 minutes. An electrophotographic photosensitive member was thereby produced. Images were evaluated using this electrophotographic photosensitive member in the same manner as in Example 5. The results are shown in Table 19. Binder resin: polyvinyl butyral (trade name: BM-1, manufactured by Sekisui Chemical Co., Ltd.) (62.7 parts) and blocked isocyanate (trade name: Sumidur 3175, manufactured by Covestro Japan Ltd.) (47.1 parts). Solvent: methyl ethyl ketone (90 parts), cyclohexanone (90 parts).

Example 12

An undercoat layer was formed in the same manner as in Example 11 except that the amount of the zinc-doped tin oxide-coated titanium oxide particle used in the undercoat layer in Example 11 was changed from 219 parts to 54.8 parts. An electrophotographic photosensitive member was thereby produced. Images were evaluated using this electrophotographic photosensitive member in the same manner as in Example 11. The results are shown in Table 19.

Example 13

An undercoat layer was formed in the same manner as in Example 11 except that the amount of the zinc-doped tin oxide-coated titanium oxide particle used in the undercoat layer in Example 11 was changed from 219 parts to 164 parts. An electrophotographic photosensitive member was thereby produced. Images were evaluated using this electrophotographic photosensitive member in the same manner as in Example 11. The results are shown in Table 19.

Example 14

An undercoat layer was formed in the same manner as in Example 11 except that the amount of the zinc-doped tin oxide-coated titanium oxide particle used in the undercoat layer in Example 11 was changed from 219 parts to 438 parts. An electrophotographic photosensitive member was thereby produced. Images were evaluated using this electrophotographic photosensitive member in the same manner as in Example 11. The results are shown in Table 19.

Example 15

An undercoat layer was formed in the same manner as in Example 5 except that the mass proportion (coating rate) of tin oxide to the zinc-doped tin oxide-coated titanium oxide particle in the undercoat layer in Example 5 was changed from 30% by mass to 5% by mass. An electrophotographic photosensitive member was thereby produced. Images were evaluated using this electrophotographic photosensitive member in the same manner as in Example 5. The results are shown in Table 19.

Example 16

An undercoat layer was formed in the same manner as in Example 5 except that the mass proportion of tin oxide to the zinc-doped tin oxide-coated titanium oxide particle in the undercoat layer in Example 5 was changed from 30% by mass to 10% by mass. An electrophotographic photosensitive member was thereby produced. Images were evaluated using this electrophotographic photosensitive member in the same manner as in Example 5. The results are shown in Table 19.

Example 17

An undercoat layer was formed in the same manner as in Example 5 except that the mass proportion of tin oxide to the zinc-doped tin oxide-coated titanium oxide particle in the undercoat layer in Example 5 was changed from 30% by mass to 60% by mass. An electrophotographic photosensitive member was thereby produced. Images were evaluated using this electrophotographic photosensitive member in the same manner as in Example 5. The results are shown in Table 19.

Example 18

An undercoat layer was formed in the same manner as in Example 5 except that the mass proportion of tin oxide to the zinc-doped tin oxide-coated titanium oxide particle in the undercoat layer in Example 5 was changed from 30% by mass to 65% by mass. An electrophotographic photosensitive member was thereby produced. Images were evaluated using this electrophotographic photosensitive member in the same manner as in Example 5. The results are shown in Table 19.

Example 19

An undercoat layer was formed in the same manner as in Example 5 except that the thickness of the undercoat layer in Example 5 was changed to 15 μm. An electrophotographic photosensitive member was thereby produced. Images were evaluated using this electrophotographic photosensitive member in the same manner as in Example 5. The results are shown in Table 19.

Example 20

An undercoat layer was formed in the same manner as in Example 5 except that the thickness of the undercoat layer in Example 5 was changed to 40 μm. An electrophotographic photosensitive member was thereby produced. Images were evaluated using this electrophotographic photosensitive member in the same manner as in Example 5. The results are shown in Table 19.

Example 21

An intermediate layer was formed in the same manner as in Example 5 except that exemplified compound A101 used in the intermediate layer in Example 5 was replaced with the electron transporting material represented by the following formula. An electrophotographic photosensitive member was thereby produced.

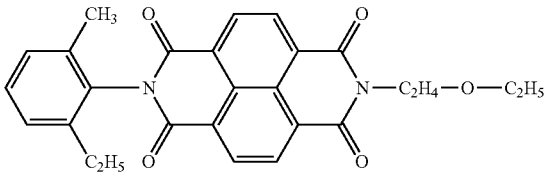

The volume of the complex particle in the total volume of the undercoat layer in Example 21 is 24.3% by volume. The specific gravity of all the materials used in the intermediate layer in Example 21 is 1.0 g/cm$^3$. Accordingly, the volume of the electron transporting material in the total volume of the composition of the intermediate layer is 40% by volume. Consequently, the volume of the complex particle in the total volume of the undercoat layer is 0.61 times the volume of the electron transporting material in the total volume of the composition of the intermediate layer.

Example 22

An electrophotographic photosensitive member was produced in the same manner as in Example 1 except that an intermediate layer was formed on the undercoat layer in Example 1 as follows. Images were evaluated using this electrophotographic photosensitive member in the same manner as in Example 5. The results are shown in Table 19.

(Formation of Intermediate Layer)

8.5 parts of an electron transporting material (exemplified compound A118), 15 parts of a blocked isocyanate compound (trade name: SBN-70D, manufactured by Asahi Kasei Chemicals Corporation), 0.97 parts of a poly(vinyl acetal) resin (trade name: KS-5Z, manufactured by Sekisui Chemical Co., Ltd.) as a resin, and 0.15 parts of zinc(II) hexanoate (manufactured by Mitsuwa Chemicals Co., Ltd.) as a catalyst were dissolved in a mixed solvent of 88 parts of 1-methoxy-2-propanol and 88 parts of tetrahydrofuran to prepare a coating solution for an intermediate layer. The coating solution for an intermediate layer was applied onto the undercoat layer in Example 1 through immersion application to form a coating, and the coating was cured (polymerized) through heating at 170° C. for 20 minutes to form an intermediate layer having a thickness of 0.6 μm.

Example 23

An electrophotographic photosensitive member was produced in the same manner as in Example 1 except that the undercoat layer in Example 1 was replaced with the undercoat layer formed as follows.

(Formation of Undercoat Layer)

219 parts of a zinc-doped tin oxide-coated titanium oxide particle (powder resistivity: $5.0\times10^7$ Ω·cm, tin oxide coating rate: 35% by mass, average primary particle diameter: 200 nm), 36 parts of a zinc-doped tin oxide particle (powder resistivity: $5.0\times10^7$ Ω·cm), 146 parts of a phenol resin (monomer/oligomer of a phenol resin) (trade name: Plyophen J-325, manufactured by DIC Corporation, resin solid content: 60%) as a binder resin, and 106 parts of 1-methoxy-2-propanol as a solvent were placed in a sand mill containing 420 parts of glass beads having a diameter of 1.0 mm. These materials were dispersed at a number of rotations of 2000 rpm, a dispersion time of 4 hours, and a setting temperature of cooling water of 18° C. to prepare a dispersion liquid. The glass beads were removed from the dispersion liquid through a mesh. Subsequently, 23.7 parts of silicone resin particles (trade name: Tospearl 120, manufactured by Momentive Performance Materials Inc., average particle diameter: 2 μm) as a surface roughening material, 0.024 parts of silicone oil (trade name: SH28PA, manufactured by Dow Corning Toray Co., Ltd.) as a leveling agent, 6 parts of methanol, and 6 parts of 1-methoxy-2-propanol were added to the dispersion liquid, and were stirred to prepare a coating solution for an undercoat layer. The coating solution for an undercoat layer was applied onto the support through immersion application to form a coating, and the coating was dried at 145° C. for 30 minutes to form an undercoat layer having a thickness of 30 μm. The volume proportion of zinc-doped tin oxide to the zinc-doped tin oxide-coated complex particle was 8.5% by volume.

Comparative Example 1

An undercoat layer was formed in the same manner as in Example 1 except that the zinc-doped tin oxide-coated titanium oxide particle used in the undercoat layer in Example 1 was replaced with a phosphorus-doped tin oxide-coated titanium oxide particle. An electrophotographic photosensitive member was thereby produced. Images were evaluated using this electrophotographic photosensitive member in the same manner as in Example 1. The results are shown in Table 19.

Comparative Example 2

An undercoat layer was formed in the same manner as in Example 1 except that the zinc-doped tin oxide-coated titanium oxide particle used in the undercoat layer in Example 1 was replaced with a tungsten-doped tin oxide-coated titanium oxide particle. An electrophotographic photosensitive member was thereby produced. Images were evaluated using this electrophotographic photosensitive member in the same manner as in Example 1. The results are shown in Table 19.

Comparative Example 3

An undercoat layer was formed in the same manner as in Example 1 except that the zinc-doped tin oxide-coated titanium oxide particle used in the undercoat layer in Example 1 was replaced with an antimony-doped tin oxide-coated titanium oxide particle. An electrophotographic photosensitive member was thereby produced. Images were evaluated using this electrophotographic photosensitive member in the same manner as in Example 1. The results are shown in Table 19.

Comparative Example 4

An undercoat layer was formed in the same manner as in Comparative Example 3 except that the intermediate layer used in Example 21 was disposed between the undercoat layer and the charge generating layer. An electrophotographic photosensitive member was thereby produced. Images were evaluated using this electrophotographic photosensitive member in the same manner as in Example 1. The results are shown in Table 19.

Comparative Example 5

An undercoat layer was formed in the same manner as in Example 1 except that the undercoat layer in Example 1 was replaced with the undercoat layer formed as follows. An electrophotographic photosensitive member was thereby produced. Images were evaluated using this electrophotographic photosensitive member in the same manner as in Example 1. The results are shown in Table 19. A polyolefin resin was first prepared as follows.

(Preparation of Polyolefin Resin Particle Dispersion Liquid)

A stirrer provided with a 1-L sealable glass container with a heater was used. 75.0 g of a polyolefin resin (Bondine HX-8290, manufactured by Sumitomo Chemical Co., Ltd.), 60.0 g of isopropanol, 5.1 g of triethylamine (TEA) and 159.9 g of distilled water were placed in the glass container, and were stirred with a stirring blade at a rotational speed of 300 rpm. As a result, it was verified that no precipitation of resin particulate products were found on the bottom of the container, but floated. The heater was turned on 10 minutes later, and the resin particulate products were heated while the resin particulate products kept floating. While the inner temperature of the system was kept at 140° C. to 145° C., the resin particulate products were further stirred for 20 minutes. Subsequently, the glass container was placed in a water bath to be cooled to room temperature (about 25° C.) while stirring was continued at a rotational speed of 300 rpm. The product was thereafter filtered under increased pressure (air pressure: 0.2 MPa) with a 300-mesh stainless steel filter (wire diameter: 0.035 mm, plain weave) to prepare an opaque white uniform aqueous dispersion of a polyolefin resin.

(Formation of Undercoat Layer)

10 parts of an antimony-doped tin-oxide particle (trade name: T-1, manufactured by Mitsubishi Materials Corporation) and 90 parts of isopropanol (IPA) were dispersed with a ball mill for 72 hours to prepare a tin oxide dispersion liquid. The polyolefin resin particle dispersion liquid was mixed with the tin oxide dispersion liquid such that the content of tin oxide was 4.2 parts relative to 1 part of the solid content of the polyolefin resin. Subsequently, a solvent was added such that a solvent ratio of water/IPA was 8/2, and the solid content in the dispersion liquid was 2.5% by mass, and was stirred to prepare a coating solution for an undercoat layer.

The coating solution for an undercoat layer was applied onto a support through immersion application to form a coating, and the coating was dried at 100° C. for 30 minutes to form an undercoat layer having a thickness of 30 μm.

TABLE 19

| Example | Process speed | | |
|---|---|---|---|
| Comparative Example | 0.5 s/turn | 0.3 s/turn | 0.2 s/turn |
| Example 1 | B | A | A |
| Example 2 | B | A | A |
| Example 3 | B | A | A |
| Example 4 | B | B | A |
| Example 5 | A | A | A |
| Example 6 | B | A | A |
| Example 7 | B | A | A |
| Example 8 | B | B | B |
| Example 9 | A | A | A |
| Example 10 | A | A | A |
| Example 11 | A | A | A |
| Example 12 | B | B | A |

TABLE 19-continued

| Example | Process speed | | |
|---|---|---|---|
| Comparative Example | 0.5 s/turn | 0.3 s/turn | 0.2 s/turn |
| Example 13 | A | A | A |
| Example 14 | A | B | B |
| Example 15 | B | A | A |
| Example 16 | B | A | A |
| Example 17 | A | A | B |
| Example 18 | B | B | B |
| Example 19 | A | A | B |
| Example 20 | B | A | A |
| Example 21 | A | A | B |
| Example 22 | A | A | A |
| Example 23 | A | A | A |
| Comparative Example 1 | D | D | E |
| Comparative Example 2 | B | D | E |
| Comparative Example 3 | B | E | E |
| Comparative Example 4 | B | D | E |
| Comparative Example 5 | D | E | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-126309, filed Jun. 24, 2015, which is hereby incorporated by reference herein in its entirety.

What is claimed is:

1. An electrophotographic photosensitive member comprising:

an electrically conductive support, an undercoat layer on the support, and a photosensitive layer on the undercoat layer, the undercoat layer comprising a binder resin, and a complex particle composed of a core particle coated with tin oxide doped with zinc, wherein the core particle is at least one selected from the group consisting of a zinc oxide particle, a titanium oxide particle, a barium sulfate particle and an aluminum oxide particle, and the mass ratio of the complex particle to the binder resin is 1/1 or more.

2. The electrophotographic photosensitive member according to claim 1, wherein the mass proportion of the tin oxide to the complex particle is 10 to 60% by mass.

3. The electrophotographic photosensitive member according to claim 1, wherein the mass ratio of the complex particle to the binder resin is 4/1 or less.

4. The electrophotographic photosensitive member according to claim 1, wherein the undercoat layer further comprises a tin oxide particle doped with zinc.

5. The electrophotographic photosensitive member according to claim 4, wherein a volume proportion of the tin oxide particle doped with zinc to the complex particle is 0.1 to 20% by volume.

6. The electrophotographic photosensitive member according to claim 1, wherein the binder resin is a phenol resin or a polyurethane resin.

7. The electrophotographic photosensitive member according to claim 1, wherein the electrophotographic photosensitive member has an intermediate layer comprising a polymerized product of a composition containing an electron transporting material having a reactive functional group, and the intermediate layer is disposed between the undercoat layer and the photosensitive layer.

8. The electrophotographic photosensitive member according to claim 7, wherein the composition comprises the electron transporting material having a reactive functional group, a crosslinking agent, and a resin having a reactive functional group.

9. The electrophotographic photosensitive member according to claim 7, wherein a volume of the complex particle in the total volume of the undercoat layer is 0.2 to 2 times a volume of the electron transporting material in a total volume of the composition of the intermediate layer.

10. A process cartridge detachably mountable on the main body of an electrophotographic apparatus, and integrally supporting an electrophotographic photosensitive member, and at least one unit selected from the group consisting of a charging unit, a developing unit and a cleaning unit, the electrophotographic photosensitive member comprising an electrically conductive support, an undercoat layer on the support, and a photosensitive layer on the undercoat layer, and the undercoat layer comprising a binder resin, and a complex particle composed of a core particle coated with tin oxide doped with zinc, wherein the core particle is at least one selected from the group consisting of a zinc oxide particle, a titanium oxide particle, a barium sulfate particle and an aluminum oxide particle, and the mass ratio of the complex particle to the binder resin is 1/1 or more.

11. An electrophotographic apparatus comprising an electrophotographic photosensitive member, a charging unit, an exposure unit, a developing unit, and a transfer unit, the electrophotographic photosensitive member comprising an electrically conductive support, an undercoat layer on the support, and a photosensitive layer on the undercoat layer, and the undercoat layer comprising a binder resin, and a complex particle composed of a core particle coated with tin oxide doped with zinc, wherein the core particle is at least one selected from the group consisting of a zinc oxide particle, a titanium oxide particle, a barium sulfate particle and an aluminum oxide particle, and the mass ratio of the complex particle to the binder resin is 1/1 or more.

* * * * *